US011125400B2

(12) United States Patent
Miles et al.

(10) Patent No.: US 11,125,400 B2
(45) Date of Patent: Sep. 21, 2021

(54) OUTDOOR LIGHT FIXTURES

(71) Applicant: AXIS LIGHTING INC., Lasalle (CA)

(72) Inventors: Andrew Miles, Lasalle (CA); Hristea Mihalcea, Lasalle (CA); Howard Yaphe, Lasalle (CA)

(73) Assignee: Axis Lighting Inc., LaSalle (CA)

( * ) Notice: Subject to any disclaimer, the term of this patent is extended or adjusted under 35 U.S.C. 154(b) by 0 days.

(21) Appl. No.: 16/725,789

(22) Filed: Dec. 23, 2019

(65) Prior Publication Data

US 2020/0208796 A1 Jul. 2, 2020

Related U.S. Application Data

(60) Provisional application No. 62/819,186, filed on Mar. 15, 2019, provisional application No. 62/784,662, filed on Dec. 24, 2018.

(51) Int. Cl.

| | |
|---|---|
| ***F21S 4/28*** | (2016.01) |
| ***F21S 8/00*** | (2006.01) |
| ***F21V 31/00*** | (2006.01) |
| ***F21V 5/00*** | (2018.01) |
| ***F21V 15/01*** | (2006.01) |
| ***F21Y 115/10*** | (2016.01) |

(52) U.S. Cl.

CPC ..... *F21S 4/28* (2016.01); *F21S 8/036* (2013.01); *F21V 5/007* (2013.01); *F21V 15/01* (2013.01); *F21V 31/005* (2013.01); *F21Y 2115/10* (2016.08)

(58) Field of Classification Search

CPC .. F21S 4/28; F21S 8/036; F21V 5/007; F21V 15/01; F21V 31/005

USPC ..... 362/335

See application file for complete search history.

(56) References Cited

U.S. PATENT DOCUMENTS

| | | | | |
|---|---|---|---|---|
| 6,354,714 | B1 | 3/2002 | Rhodes | |
| 7,559,672 | B1 * | 7/2009 | Parkyn | A47B 97/00 362/127 |
| 9,316,363 | B2 * | 4/2016 | Lee | F21S 2/005 |

(Continued)

OTHER PUBLICATIONS

Axis Lighting, "Wet Beam DI," Retrieved on-line from https://www.axislighting.com/application/files/5915/6683/2689/Wet_Beam_DI_LED_from_Catalogue.pdf (2011).

(Continued)

*Primary Examiner* — Bryon T Gyllstrom

(74) *Attorney, Agent, or Firm* — Barnes & Thornburg LLP

(57) ABSTRACT

A light fixture device having at least one sealed LED lighting cartridge and a sealed casing with a lens region along one boundary thereof. The device includes one or more power supply elements extending from or accessible from the casing which are connectible with a power source. A housing of the device has at least one first housing structure defining at least two opposed cartridge-receiving zones. Each of the zones has a corresponding light output region cartridge-receiving and is configured to receive at least one sealed LED lighting cartridge with the lens region aligned with the corresponding light output region. A central interior cavity is provided to accommodate the power supply elements between, at least in part, the cartridge-receiving zones. At least one second housing structure to sealingly engage with the housing structure and sealingly close the central interior cavity.

7 Claims, 19 Drawing Sheets

(56) References Cited

U.S. PATENT DOCUMENTS

| | | | | |
|---|---|---|---|---|
| 2003/0174517 | A1* | 9/2003 | Kiraly | G01N 21/8806 362/555 |
| 2007/0258244 | A1 | 11/2007 | Curran et al. | |
| 2009/0207592 | A1* | 8/2009 | Otsuki | F21V 7/0025 362/125 |
| 2011/0058357 | A1* | 3/2011 | Anderson | A47F 3/001 362/125 |
| 2011/0222270 | A1* | 9/2011 | Porciatti | F24F 3/056 362/147 |
| 2012/0014107 | A1* | 1/2012 | Avila | F21S 4/28 362/294 |
| 2012/0120644 | A1 | 5/2012 | Rieger | |
| 2014/0104829 | A1* | 4/2014 | Kuhn | F21S 4/28 362/231 |
| 2015/0308631 | A1* | 10/2015 | Gorman | F21S 4/28 362/221 |
| 2017/0108205 | A1 | 4/2017 | Schainker | |
| 2019/0101682 | A1* | 4/2019 | Douglas | F21V 7/05 |
| 2019/0293269 | A1* | 9/2019 | Roys | F21V 23/001 |
| 2019/0346094 | A1* | 11/2019 | Chung | H01L 33/62 |
| 2020/0141556 | A1* | 5/2020 | Yu | F21V 15/01 |

OTHER PUBLICATIONS

OCL Architectural Lighting, "Skyline, Ceiling / Wall / Recessed," Retrieved on-line from www.ocl.com, Publicly available before Dec. 23, 2019.

Wikipedia, "IP Code," Retrieved on-line from https://en. wikipediaorg/w/index.php?title=IP~ Code&oldid=931693217 on Dec. 20, 2019.

* cited by examiner

OUTDOOR LIGHT FIXTURES

REFERENCE TO CO-PENDING APPLICATIONS

The disclosure claims priority benefit from the applications referenced below, and the disclosures set forth therein are incorporated herein by reference in their entities:

U.S. Provisional Application 62/784,662, filed: Dec. 24, 2018, entitled OUTDOOR LIGHT FIXTURES; and U.S. Provisional Application 62/819,186 filed Mar. 15, 2019 and entitled OUTDOOR LIGHT FIXTURES This subject matter of the following applications is incorporated herein by reference in their entireties:

U.S. Provisional application 62/532,977 filed Jul. 14, 2017 entitled ACOUSTIC PANEL is incorporated herein by reference;

U.S. Design patent application 29/610,783, filed Jul. 14, 2017 entitled LUMINAIRE STRUCTURE;

U.S. Design patent application 29/615,179, filed Aug. 26, 2017 entitled LUMINAIRE STRUCTURE; and U.S. patent application Ser. No. 16/004,057, filed Jun. 8, 2018 entitled ACOUSTIC PANEL.

FIELD OF THE DISCLOSURE

The present disclosure relates to outdoor light fixture structures and associated structures.

BACKGROUND

Outdoor light fixtures are generally fitted to withstand extremes of weather and moisture and are known to be prone to corrosion. Thus, the specifications required to combat the elements usually involves larger dimension structures, seals and the like, thus in some case at a cost to design and size. These limitations cause current outdoor lighting design to lag developments currently underway in indoor lighting design, particularly the flexibilities seen with the advent of light emitting diode (LED) technologies.

It would thus be desirable to provide novel approaches for outdoor light fixture capabilities, or at least to provide the public with one or more useful alternatives.

SUMMARY

In an aspect, there is provided linear light fixture device comprising: at least one sealed linear LED lighting cartridge having a sealed casing with a linear lens region along one boundary thereof, and one or more power supply elements extending or accessible from the casing which are connectible with a power source. A linear housing comprises at least one first linear housing structure defining at least two opposed linear cartridge-receiving zones, each with a corresponding light output region, at least one linear cartridge-receiving zone configured to receive an instance of the at least one sealed linear LED lighting cartridge with the linear lens region alignable with the corresponding light output region; a central interior cavity to accommodate the power supply elements and between, at least in part, the linear cartridge-receiving zones, and at least one second linear housing structure to sealingly engage the at least one first linear housing structure.

In some example embodiments, the at least one first linear housing structure may define a pair of opposed first linear sealing surface regions with each first linear sealing surface region adjacent a corresponding linear cartridge-receiving zone.

In some example embodiments, each first linear sealing surface region may be located between a corresponding linear cartridge-receiving zone and the central interior cavity.

In some example embodiments, the at least one first linear housing structure may comprise a first housing panel which borders a first linear boundary of each of the linear cartridge-receiving zones, and/or the at least one second linear housing structure may comprise a second housing panel which borders a second linear boundary of each of the linear cartridge-receiving zones.

In some example embodiments, the first housing panel may include a first central portion bordering the central interior cavity, and presenting the first linear sealing surface regions.

In some example embodiments, the second housing panel may include a second central portion with opposed second linear sealing surface regions to sealingly engage the respective first linear sealing surface regions.

Some example embodiments may further comprise at least a pair of gasket elements to be located in respective sealing interfaces between each first linear sealing surface region and a corresponding second linear sealing surface region.

In some example embodiments, the first linear housing structure may include at least one end cap segment to sealingly engage with the first and second housing panels.

In some example embodiments, the central interior cavity may include a cavity adjacent the end cap segment to form a passage for the one or more power supply elements extending from one end of the at least one linear LED lighting cartridge and the central interior cavity.

Some example embodiments may further comprise an anchor structure adjacent the central interior cavity to be alignable with the second central portion for anchoring the second central portion thereto.

In some example embodiments, the second central portion and the anchor structure may include aligned passages to receive at least one anchoring fastener therebetween.

Some example embodiments may further comprise at least cover portion to conceal and/or cover the first housing panel or the second housing panel, at least in part.

In another aspect, there is provided a light fixture device comprising a first housing structure configured to define at least two cartridge-receiving zones, each configured to receive a light fixture cartridge. At least one central interior cavity is adjacent each of the cartridge-receiving zones, wherein each cartridge-receiving zone and central interior cavity is accessible via a common access opening extending along one side region of the first housing structure. At least two sealing interfaces are provided of which each extends between a common boundary between the central interior cavity and one of the cartridge-receiving zones, and a second housing structure configured to engage the first housing structure at the at least two sealing interfaces to close the at least two cartridge-receiving zones.

Some example embodiments may further comprise at least one first light fixture cartridge configured to be received in either of the at least two cartridge-receiving zones, and/or the first light fixture cartridge may include an illumination source and operable to interconnect with a power source in the central interior cavity.

Some example embodiments may further comprise a second cartridge configured to be received in either of the at least two cartridge-receiving zones, wherein the second cartridge may include at least one lighting or non-lighting accessory.

In some example embodiments, the lighting accessory may include at least one lens, louver array, diffuser or filter.

In some example embodiments, the non-lighting accessory may include at least one acoustic panel and or cover plate.

In another aspect, there is provided a light fixture, comprising a device of any aspect, example embodiment, clause or claim herein, and a light fixture cartridge installed in each of the at least two cartridge-receiving zones, wherein each light fixture cartridge is selected from a group comprising at least one first light fixture cartridge and at least one second cartridge.

In another aspect, there is provided a light fixture, comprising a device of any aspect, example embodiment, clause or claim herein, and a light fixture cartridge installed in each of the least at two cartridge-receiving zones.

In another aspect, there is provided a light fixture structure comprising at least one first housing structure defining at least two opposed cartridge-receiving zones, each with a corresponding light output region, each cartridge-receiving zone configured to receive an instance of at least one sealed LED lighting cartridge. A central interior cavity is provided between, at least in part, the cartridge-receiving zones, at least on part, to accommodate one or more light fixture accessories. At least one second housing structure is provided to sealingly engage the at least one first housing structure, thereby to sealingly close the central interior cavity and/or at least one of the cartridge-receiving zones.

Some example embodiments may further comprise at least one sealed LED lighting cartridge having a sealed casing with a lens region along one boundary thereof, and one or more of the light fixture assemblies include one or more power supply elements extending from or accessible at the casing, which are connectible with a power source.

In another aspect, there is provided a light fixture system comprising at least two opposed housing structures configured to mutually engage to form a light fixture housing with a pair of opposed light fixture boundaries, at least one of the housing structures being further configured to define at least two cartridge-receiving zones, with each being adjacent a corresponding light fixture boundary, each cartridge-receiving zone being configured to receive an instance of at least one sealed cartridge, so that the instance can be received by one or either of the cartridge receiving zones. At least one of the housing structures or a portion thereof is removable to expose at least one cartridge receiving zone from a side region of the light fixture housing and between the opposed light fixture boundaries, to enable the instance to be installed or removed therefrom when the light fixture housing is in position at a light fixture location.

In another aspect, there is provided a light fixture system comprising at least two opposed housing structures configured to mutually engage to form a light fixture housing with a pair of opposed light fixture boundaries, at least one of the housing structures being further configured to define at least two housing zones with each being adjacent a corresponding light fixture boundary, at least one of the housing zones being a cartridge-receiving zone which is configured to receive an instance of at least one cartridge. At least one of the housing structures or a portion thereof is removable to expose the cartridge-receiving zone from a side region of the light fixture housing and between the opposed light fixture boundaries, to enable the cartridge to be installed or removed therefrom when the light fixture housing is in position at a light fixture location.

Some example embodiments may further comprise the at least one instance of the cartridge.

In some example embodiments, the at least one instance of the cartridge includes a plurality of cartridges including at least one LED lighting cartridge.

In some example embodiments, a first of the at least two housing structures includes inner structure to form at least one inner mounting interface with a corresponding cartridge in the at least one cartridge-receiving zone.

In some example embodiments, the first housing structure and/or a second of the at least two housing structures includes outer structure to form at least one outer mounting interface with a corresponding cartridge in the cartridge-receiving zone.

In some example embodiments, each mounting interface includes at least a pair of complementary surfaces respectively on the inner or outer structure and the corresponding cartridge.

In some example embodiments, the second housing structure or a portion thereof, is releasable from the first housing structure to form a side opening to access at least one of the housing zones.

In some example embodiments, the second housing structure includes a pair of cover portions, at least one of the cover portions being independently removable to expose one of the housing zones.

In some example embodiments, the cover portions includes a first cover portion mountable to the first housing structure, and a second cover portion mountable between the first cover portion and the first housing structure.

In some example embodiments, the first cover portion includes a mounting tab to receive a complementary tab on the second cover portion.

In another aspect, there is provided a light fixture cartridge configured to be received in any one of the at least two cartridge-receiving zones of the light fixture device as defined herein, the light fixture cartridge including an illumination source and operable to interconnect with a power source in the central interior cavity.

In some example embodiments, the illumination source includes a light guide, and at least one LED array aligned with an edge region thereof, and at least one reflector segment positioned adjacent the light guide.

In some example embodiments, the illumination source includes a light guide with a first edge region having at least one LED array aligned therewith to deliver light thereto, and a second edge region opposite the first edge region, with at least one reflector segment extending from the second edge region.

In some example embodiments, the at least one reflector segment extends, at least in part, between the first and second edge regions.

In some example embodiments, the at least one reflector segment includes a first segment extending, at least in part, between the first and second edge regions and a second segment extending along the second edge region.

In another aspect, there is provided a light fixture cartridge configured to be received in a cartridge-receiving zone of a light fixture device comprising an illumination source and operable to interconnect with a power source accessible in the cartridge-receiving zone, the illumination source further comprising a light guide, and at least one LED array aligned with an edge region thereof, and at least one reflector positioned adjacent the light guide and configured to provide a substantially symmetrical light distribution.

In another aspect, there is provided a method of assembling a light fixture, comprising:

a. providing at least one first housing structure defining at least two opposed cartridge-receiving zones, each with a corresponding light output region extending along opposite boundaries, each cartridge-receiving zone open to a lateral boundary between the light output regions and configured to receive an instance of at least one sealed LED lighting cartridge; and at least one second housing structure to sealingly engage the at least one first housing structure at the lateral boundary;

b. installing the at least one first housing structure at a light fixture location to present at least one of the cartridge-receiving zones;

c. providing a plurality of cartridges, including at least one instance of the LED lighting cartridge;

d. installing the instance of the at least one LED lighting cartridge in the presented at least one corresponding cartridge-receiving zone;

e. installing another cartridge in the opposite cartridge-receiving zone; and f. installing the at least one second housing structure to sealingly engage the first housing structure, at least in part.

In another aspect, there is provided a method of assembling a light fixture, comprising:

a. providing at least one first housing structure defining at least one cartridge-receiving zone with a corresponding light output region extending along at least one of a pair of opposed boundaries, the at least one cartridge-receiving zone open to a lateral boundary between the opposed boundaries and configured to receive an instance of at least one sealed LED lighting cartridge; and at least one second housing structure to sealingly engage the at least one first housing structure at the lateral boundary, at least in part;

b. installing the at least one first housing structure at a light fixture location to present at least one cartridge-receiving zone;

c. providing the at least one instance of the LED lighting cartridge;

d. installing the at least one instance of the LED lighting cartridge in the presented at least one corresponding cartridge-receiving zone; and e. installing the at least one second housing structure to sealingly engage the at least the one cartridge-receiving zone with the instance of the LED lighting cartridge therein.

BRIEF DESCRIPTION OF THE FIGURES

Several exemplary embodiments of the present disclosure will be provided, by way of examples only, with reference to the appended drawings, wherein.

DETAILED DESCRIPTION

Figure 1:
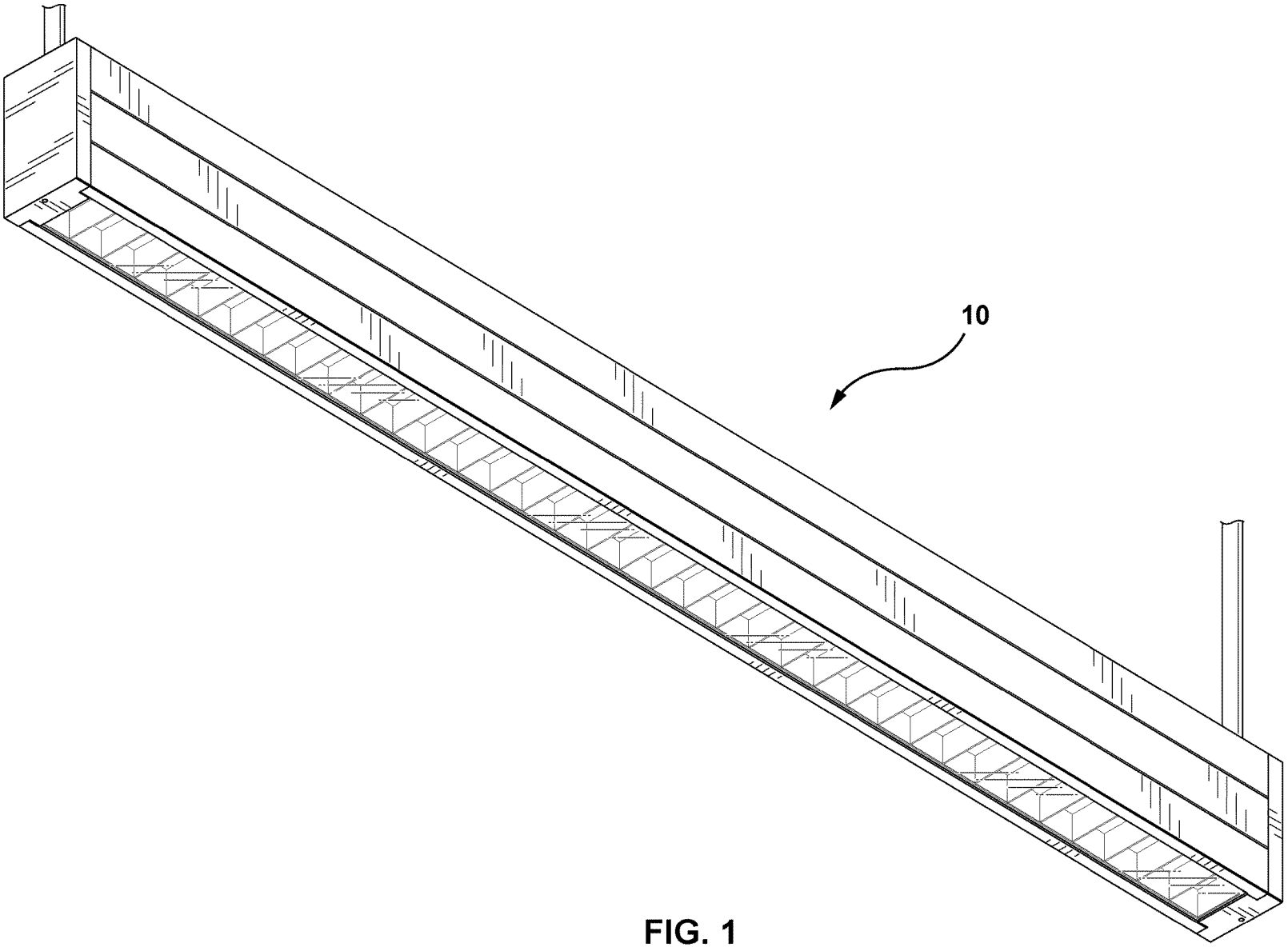
FIGS. 1 and 2 are perspective views of light fixture devices, wherein the device of FIG. 1 has louvers in a lower region and the device of FIG. 2 has a lens in a lower region.
Figure 2:
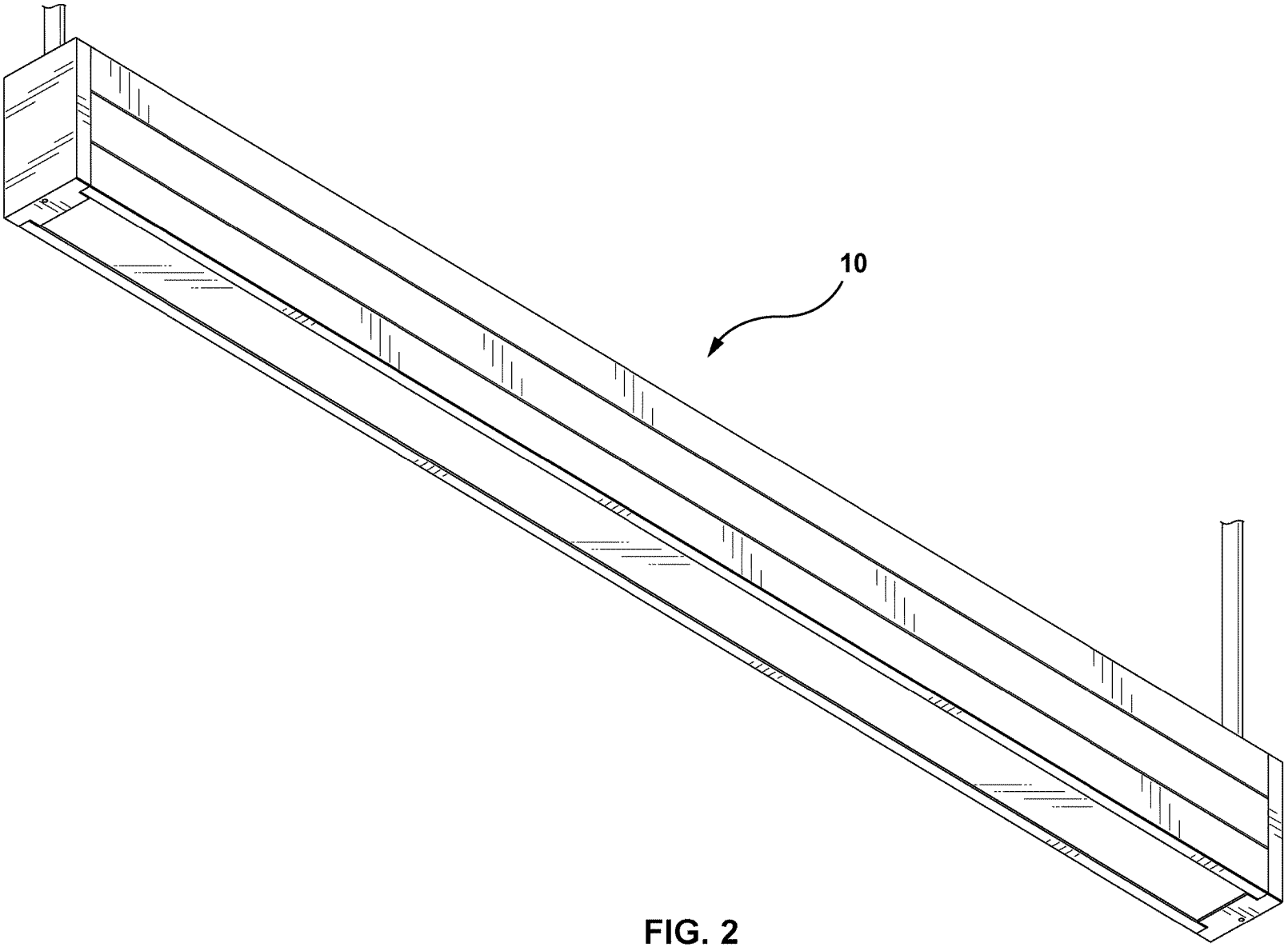

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical, mechanical or other connections or couplings. The terms upper, lower, and vertical are intended for operative context only and are not necessarily intended to limit the invention only to those configurations or orientations. Furthermore, and as described in subsequent paragraphs, the specific mechanical and/or other configurations illustrated in the drawings are intended to exemplify embodiments of the invention. However, other alternative mechanical and/or other configurations are possible which are considered to be within the teachings of the instant disclosure.

Referring to FIGS. 1 to 4, there is provided a light fixture device 10 comprising at least one, and in this case a pair of sealed LED lighting cartridges 12, 14. Each sealed LED lighting cartridge 12, 14 is provided with a sealed casing 12*a*, 14*a* with a lens region 12*b*, 14*b*, along one boundary thereof, and one or more power supply lines 12*c*, 14*c* extending from the casing which is attachable to a power source. In some example embodiments, the connection to a power source may not involve a wired supply line, and instead utilize external electrode couplings to establish a powered connection when a cartridge is installed in place. Further, some exemplary embodiments may involve battery power and wireless charging. In some example embodiments, the light fixture 10 and certain of its components, such one or more of the sealed LED lighting cartridges, may have one or more elongate dimensions so as to be referred to as linear. In other example embodiments, the light fixture 10 may be provided in other non-linear configurations.

Figure 3:
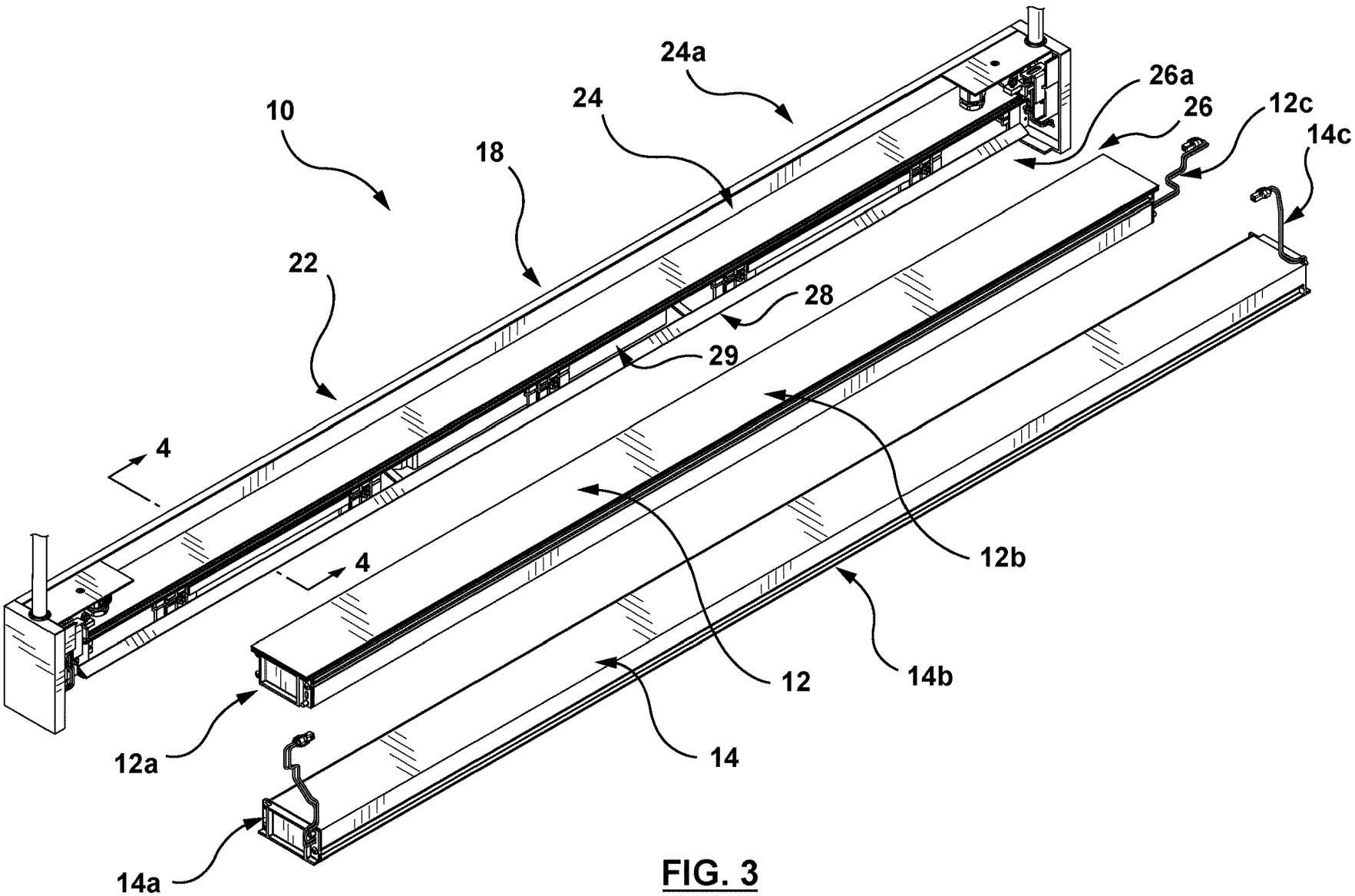
FIG. 3 is a partially exploded view of the device of FIG. 2.
Figure 4:
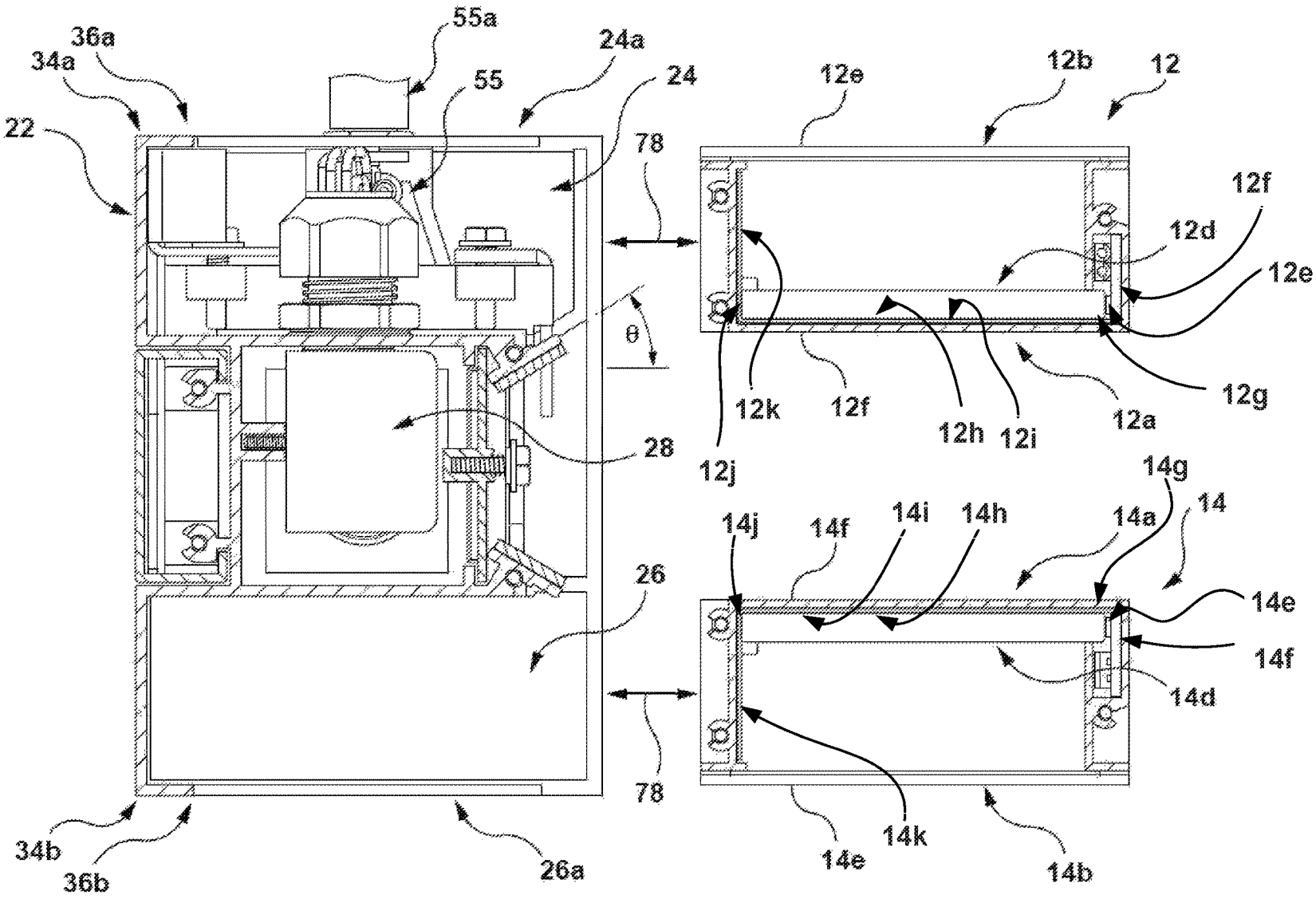
FIG. 4 is a sectional partial assembly view taken along line 4-4 of FIG. 3.
Figure 6:
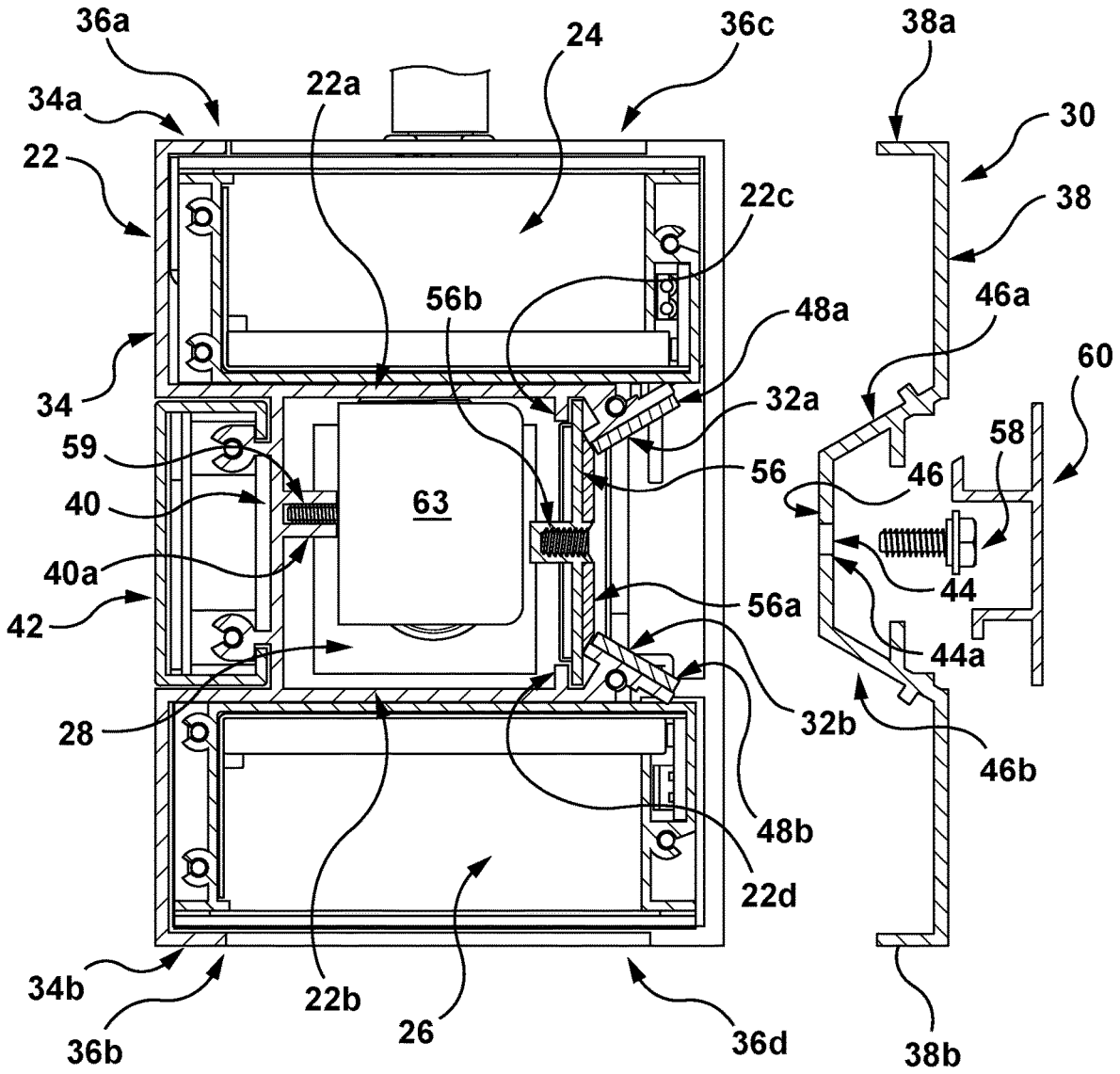
FIG. 6 is a sectional partial assembly view taken along line 6-6 of FIG. 5.
Figure 7:
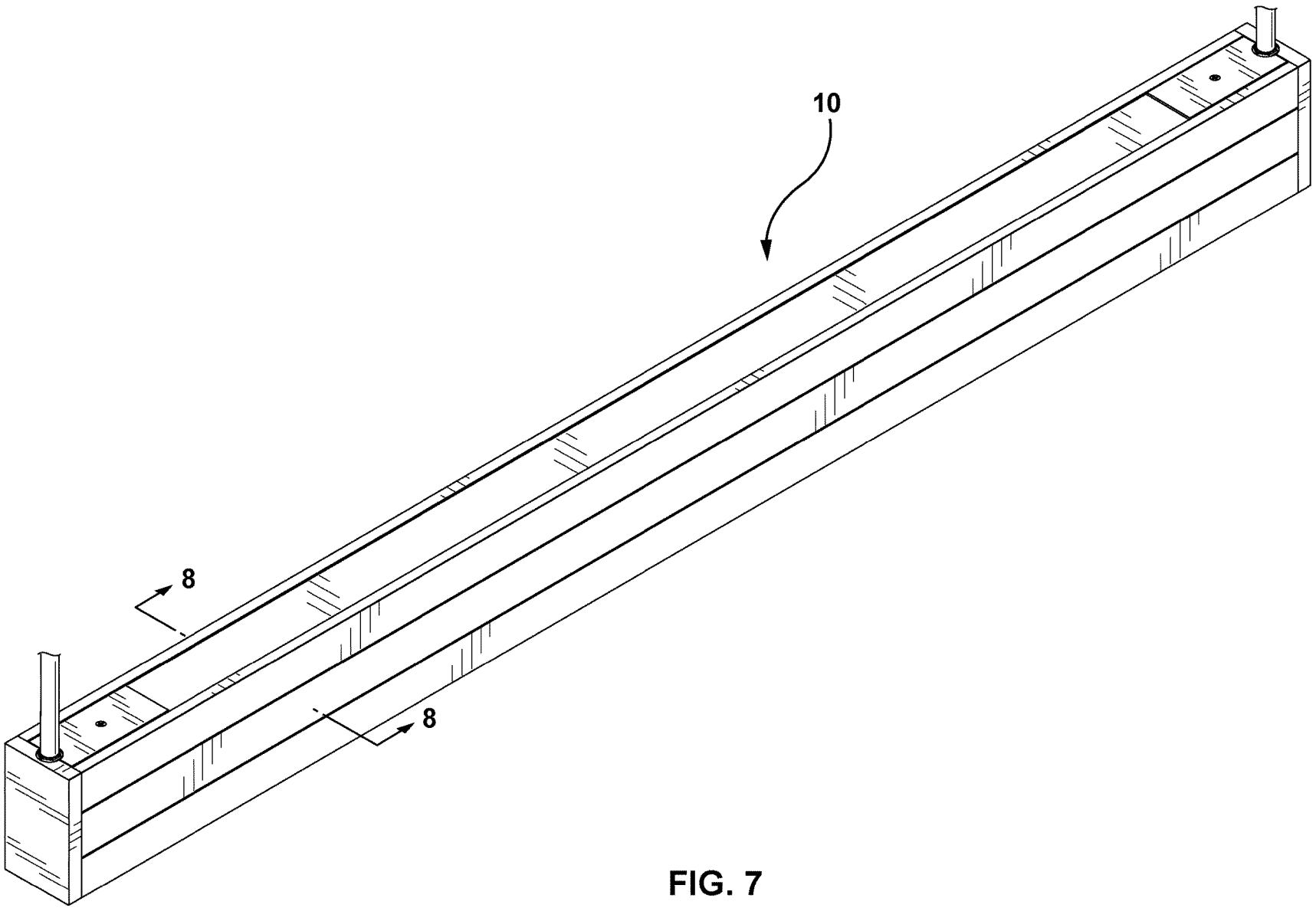
FIG. 7 is another perspective view of the device of FIG. 2.

Referring to FIGS. 3, 4 and 6, a linear housing is provided at 18 which comprises at least one first linear housing structure 22 defining, at least in part, at least two opposed linear cartridge-receiving zones, in this case upper and lower cartridge-receiving zones 24, 26, each with a corresponding light output region 24*a*, 26*a*.

Each cartridge-receiving zone 24, 26 is configured to receive, in this example embodiment, a corresponding sealed LED lighting cartridge 12, 14, with the lens region 12*b*, 14*b* of each aligned with the corresponding light output region 24*a*, 26*a*. A central interior cavity is provided at 28 to accommodate the power supply lines 12*c*, 14*c*, or a driver 29 (or a battery pack or other hardware) and between, at least in part, the upper and lower cartridge-receiving zones 24, 26. In some example embodiments, either LED cartridge 12, 14 may be received, or be operable, in either cartridge-receiving zone 24, 26, for example a part of a kit including one or more housings 18 and a plurality of cartridges 12, 14.

Referring to FIG. 6, a second linear housing structure is provided at 30 to sealingly engage the first linear housing structure 22, thereby to sealingly close the central interior cavity 28, when the cartridges 12, 14 are in place.

Referring to FIG. 6, the first linear housing structure 22 provides a pair of opposed first linear sealing surface regions 32*a*, 32*b*, with each sealing surface region adjacent a corresponding linear cartridge-receiving zone 24, 26. In some example embodiments, each first linear sealing surface region 32*a*, 32*b* may be located between a corresponding linear cartridge-receiving zone 24, 26 and the central interior cavity 28. While the linear housing 18 provides a pair of upper and lower cartridge-receiving zones, in other example embodiments the housing 18 may provide for at least one cartridge-receiving zone (such as the lower cartridge-receiving zone) while the linear housing 18 may provide for other zones. In such cases, at least one sealing surface region may be provided, such as the linear sealing surface region for the lower cartridge-receiving region while the upper region may sealed or not sealed depending on the intended contents to be received therein.

Referring to FIG. 6, the first linear housing structure 22 comprises a first housing panel 34 with end regions 34*a*, 34*b* that respectively border first linear boundaries 36*a*, 36*b* of the linear cartridge-receiving zones 24, 26. In this case, the second housing structure 30 comprises a second housing panel 38 with end regions 38*a*, 38*b* that respectively border second boundaries 36*c*, 36*d* of each of the linear cartridge-receiving zones 24, 26.

The first housing panel 34 includes a first central portion 40, which in this example embodiment is inwardly offset and adjacent the central interior cavity 28 while a first cover segment 42 may be provided to cover the first central portion.

Figure 8:
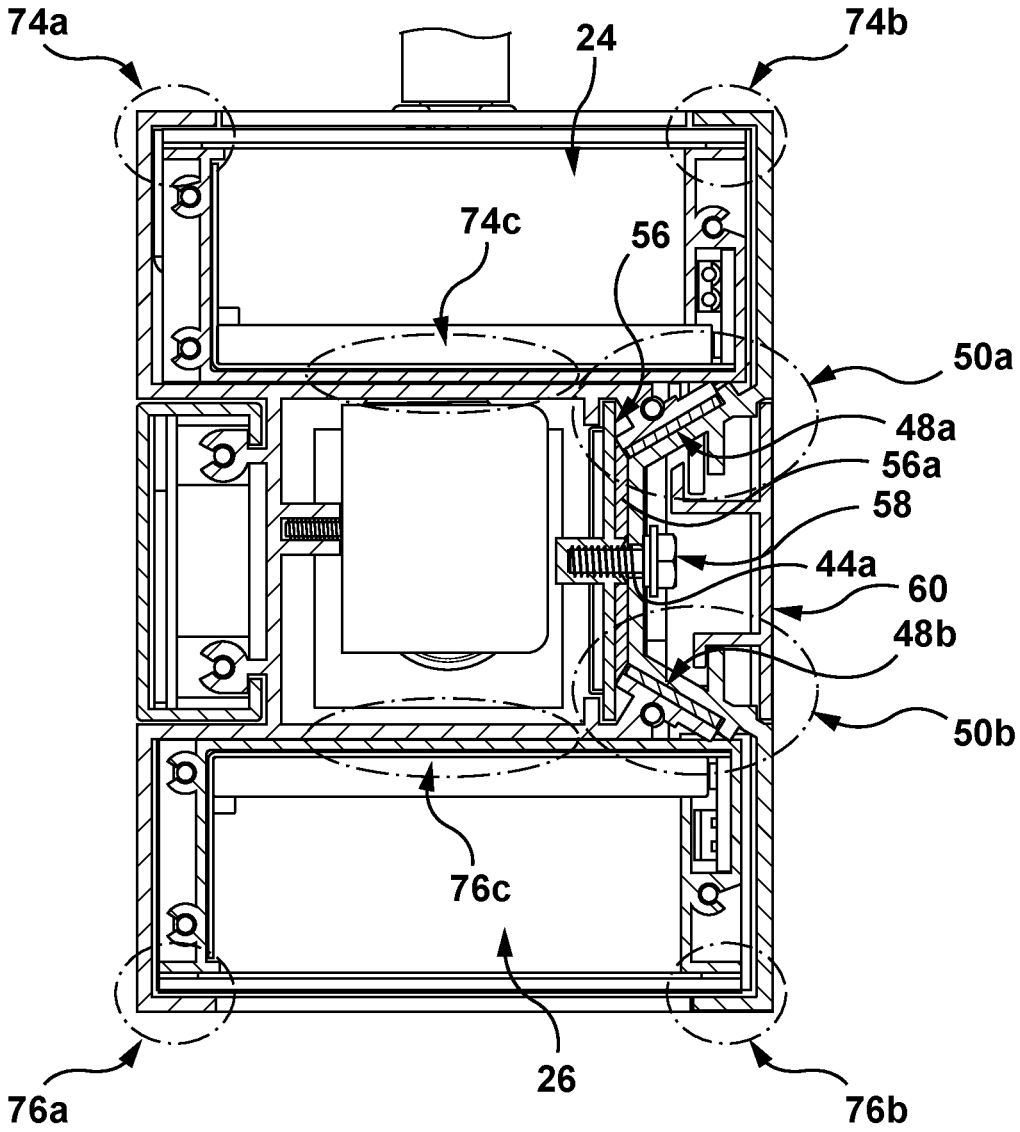
FIG. 8 is a sectional view taken along line 8-8 of FIG. 7.
Figure 9:
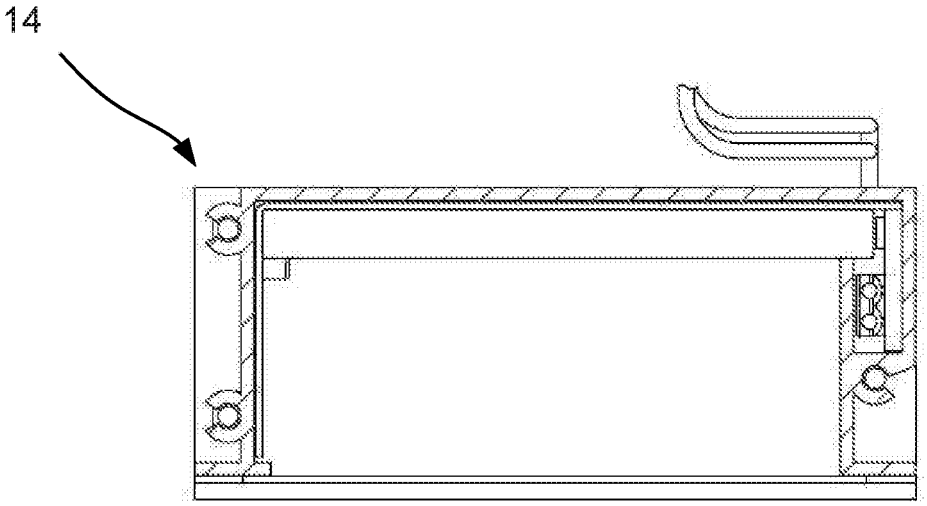
FIGS. 9 and 10 are sectional and fragmentary perspective views respectively of a lower LED cartridge shown in FIG. 8.
Figure 10:
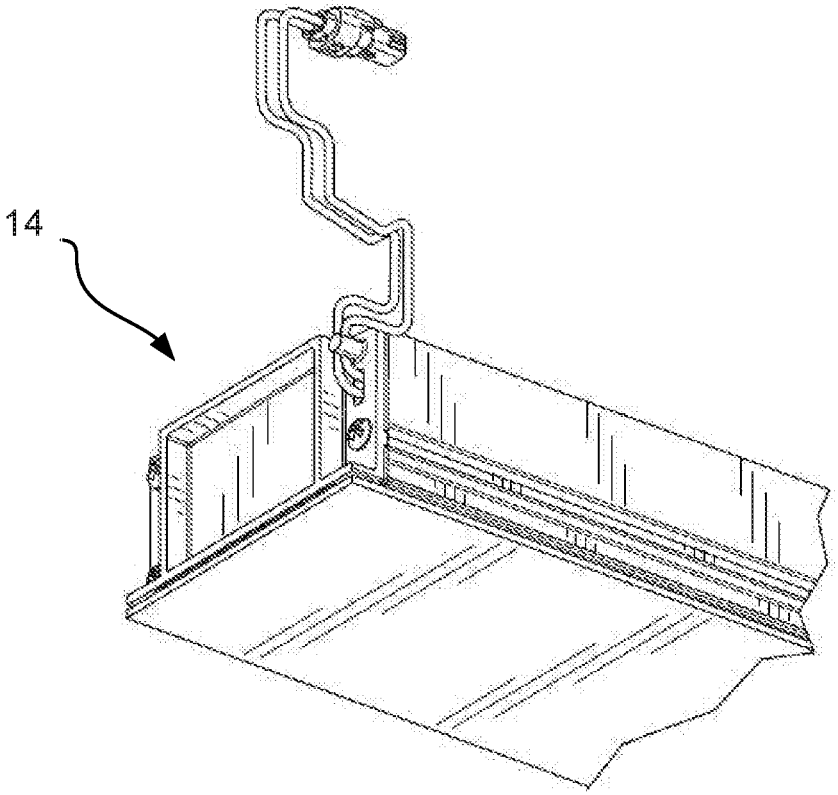

The second housing panel 38 includes a second central portion 44, of which at least a part thereof is inwardly offset, with opposed second linear sealing surface regions 46*a*, 46*b* to sealingly engage the respective first linear sealing surface regions 32*a*, 32*b*. Referring to FIGS. 6 and 8, gasket elements 48*a*, 48*b* are located in respective sealing interfaces 50*a*, 50*b* between each first linear sealing surface region 32*a*, 32*b* and corresponding second linear sealing surface region 46*a*, 46*b*.

Figure 5:
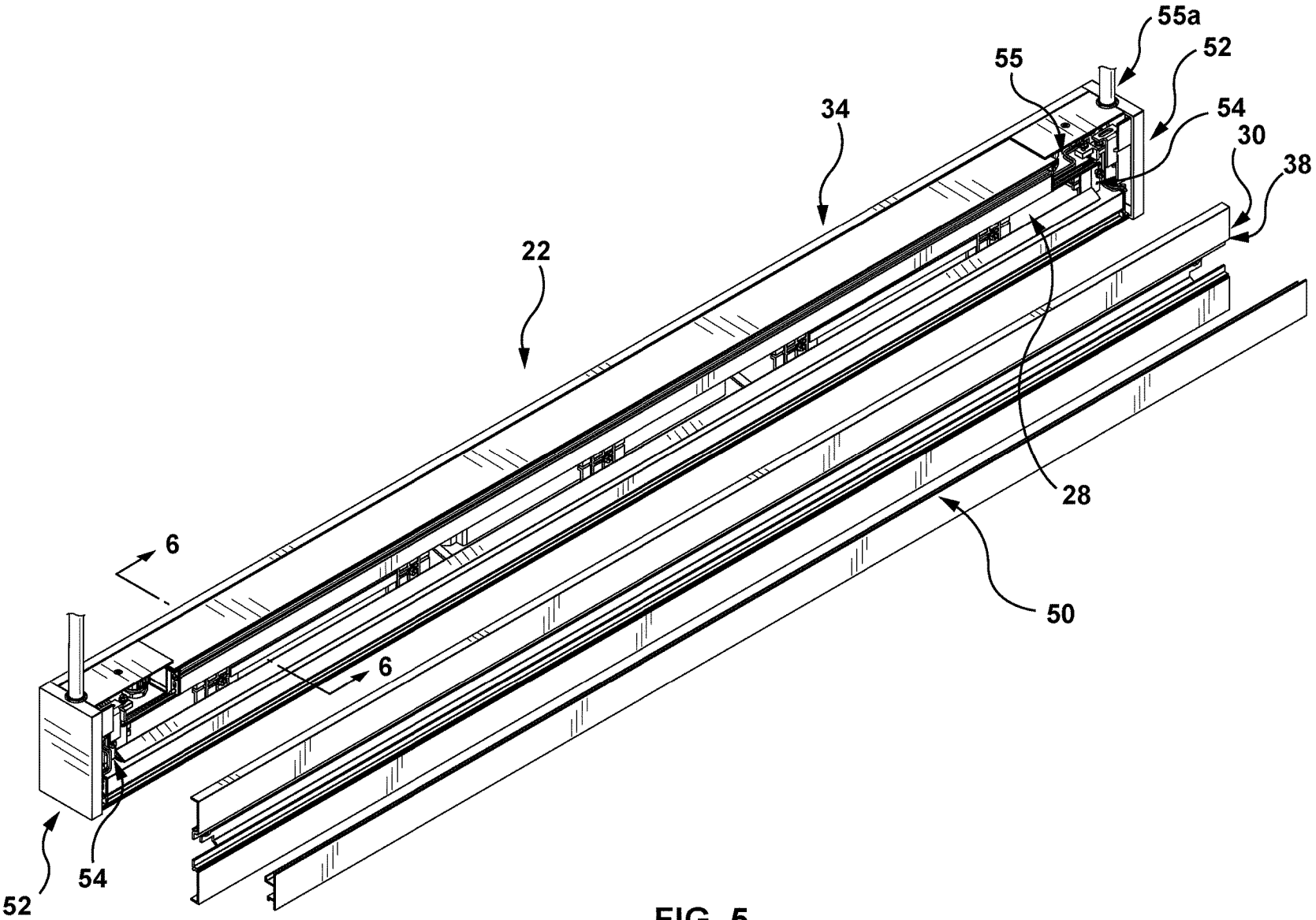
FIG. 5 is a partially exploded view of the device of FIG. 2.
Figure 17:
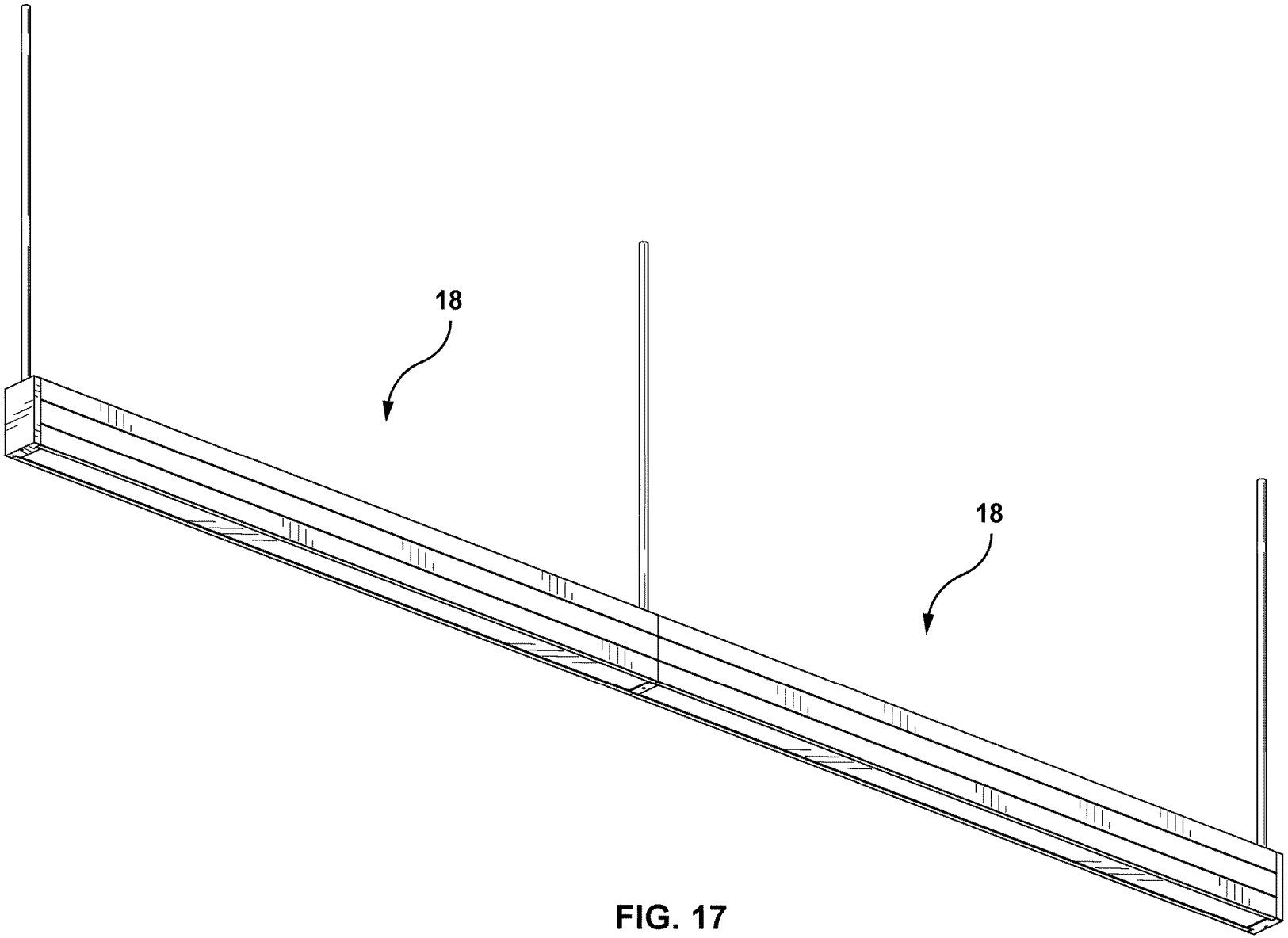
FIGS. 17 and 18 are perspective views of a light fixture device, embodying two of the devices of FIG. 2 in series.
Figure 18:
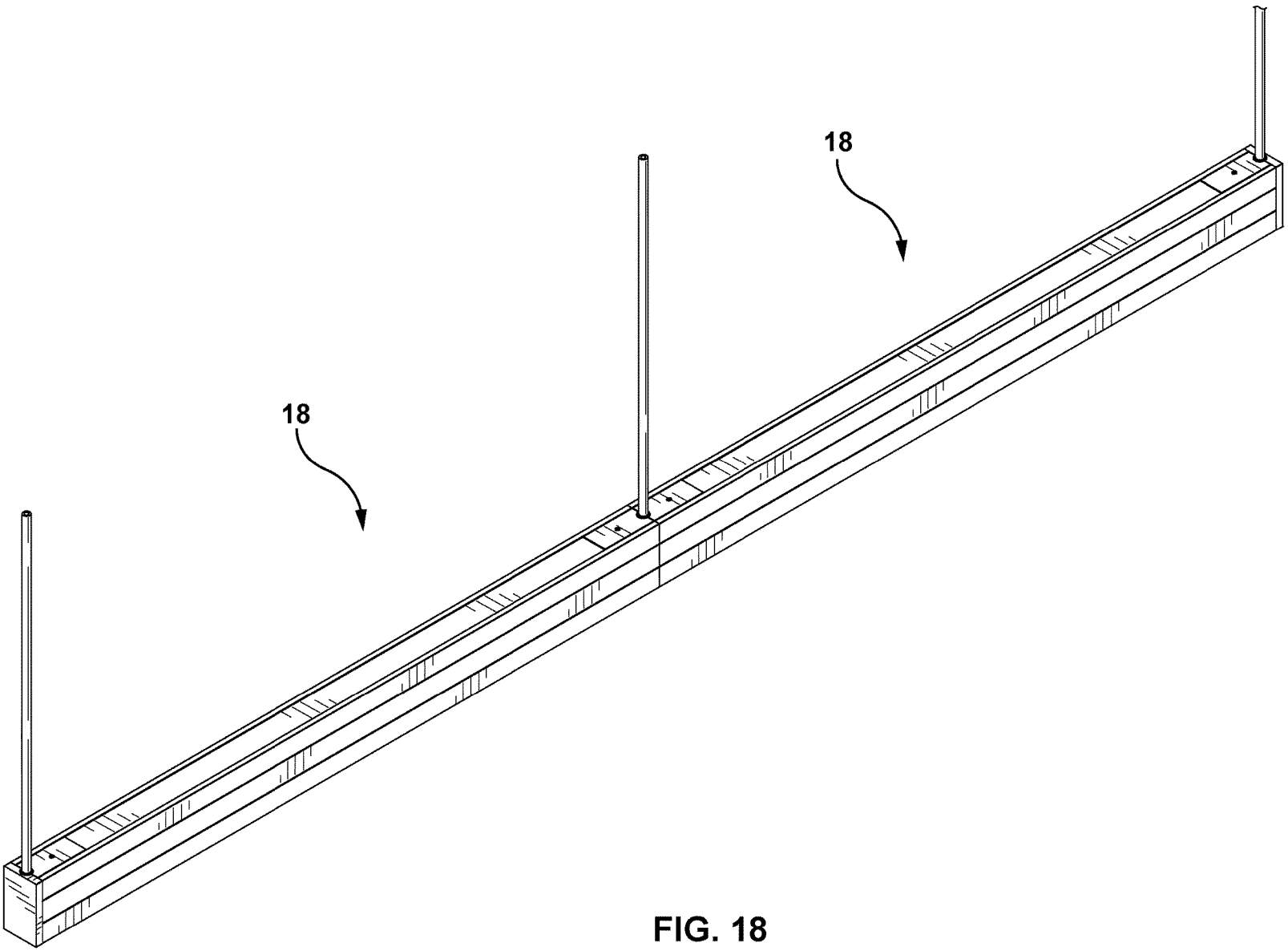
Figure 19:
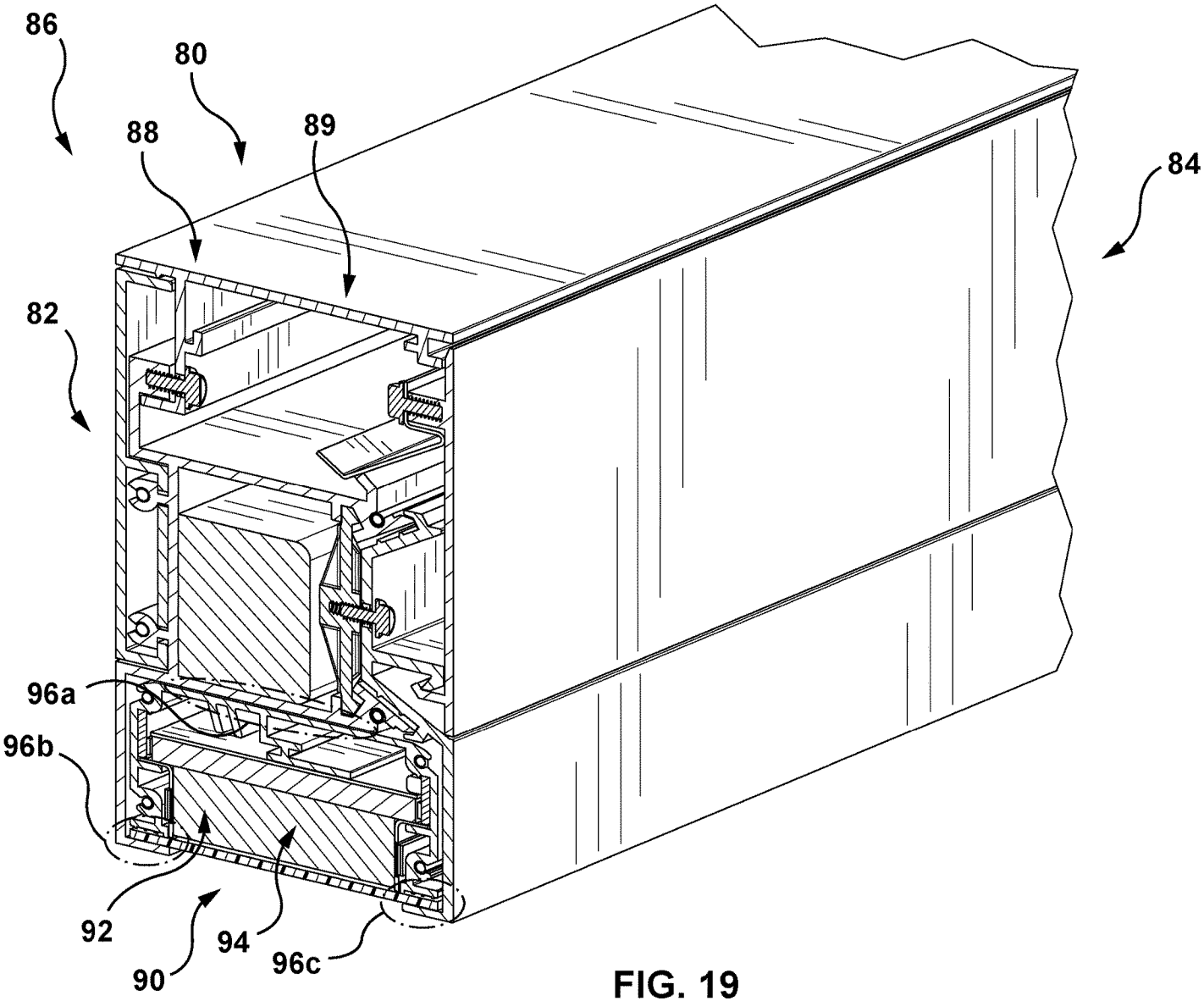
FIG. 19 is a downward perspective sectional view of another light fixture device, similar to those shown in FIGS. 4, 6, 8 and 14.

Referring to FIG. 5, the first linear housing structure 22 includes end cap segments 52 to sealingly engage with the first and second housing panels 34, 38. In some embodiments, the central interior cavity 28 may extend into an interior cavity 54 adjacent each of the end cap segments 52, which may be utilized to provide access to power supply wiring 55 to couple with an exterior power supply via conduit 55*a*. Further, the interior cavity and the associated structure may be configured for joining adjacent housings together, as shown in FIGS. 17 and 18.

Referring to FIGS. 6 and 8, an anchor structure 56 is positionable in the central interior cavity 28 to be alignable with the second central portion 44 for anchoring or positioning the second central portion 44 thereto. The second central portion 44 and anchor structure 56 include aligned passages 44*a*, 56*b* to receive at least one anchoring fastener 58 therebetween, and a second cover segment 60 may be provided to be attachable to the second central portion 44 to conceal the fastener 58. Similarly, the offset central portion 40 (of the first housing panel 34) provides at least one passage 40*a* to receive at least one fastener 59 to secure components such as a driver 63 in the central interior cavity 28. In some example embodiments, the first linear housing structure 22 may provide a pair of support walls 22*a*, 22*b* extending from the first housing panel 34 and between the upper and lower cartridge-receiving zones 24, 26 to support both the anchor structure 56, by way of flanges 22*c*, 22*d* and each of the first and second linear surface regions 32*a*, 32*b*. In some embodiments, a central gasket element may also be provided at 56*a* to seal the adjacent surfaces of the anchor structure 56 and the central linear sealing surface region 48*c* on offset second central portion 44.

In some example embodiments, the first and second linear housing structures 22 and 30 may provide a configuration in which the second linear housing structure 30, at least in part, may be removed, by withdrawing the fastener 58 to expose at least one of the upper and/or lower cartridge-receiving zones 24, 26, and more particularly in this example embodiment from the right hand as shown in FIGS. 4 and 6. This may provide a convenient and ready access to the upper and/or lower cartridge-receiving zones 24, 26 to facilitate original installation as well as in-service repairs by allowing access to the central interior cavity 28 and, when provided, the one or more end cavities 54. The sealing of the upper and lower cartridges 12 and 14 in their respective upper and lower cartridge-receiving zones 24, 26 may be achieved by way of the respective sealing interfaces 50*a*, 50*b*, (FIG. 8) between the first and second linear housing structures 22 and 30, as well as central gasket 56*a* between the anchor structure 56 and the offset central portion 44. Additional gasket elements beyond those at 48*a*, 48*b* and 56*a* may be deployed at adjacent surfaces on the first and second linear housing structures 22 and 30.

Thus, some example embodiments may be provided in various configurations in which either the lower cartridge 14 may be utilized for direct-only lighting (meaning directly lighting from the lower light output region 26*a*), the upper cartridge 12 for indirect-only lighting (meaning indirectly lighting from the upper light output region 24*a* and reflecting off a ceiling) or both. In other example embodiments, either the upper or lower linear cartridges may provide other features, shapes and functions. For instance, the cartridges may be of different lengths, as can be seen in FIG. 3 with the upper cartridge 12 being a shorter length than the lower cartridge 14, for instance as may be required to accommodate mounting hardware such as vertically oriented support members and the like. In some example embodiments, more than one cartridge may be provided therein in various orientations and combinations. In some example embodiments, the cartridges may be relatively short and take the form of pucks or the like. Either cartridge may include external formations that are not necessarily confined to the upper and/or lower boundaries of the linear housing 18. For instance, the cartridges may be provided with lens, diffuser, optical and/or acoustic elements which project beyond the upper and/or lower boundaries of the linear housing 18.

Figure 11:
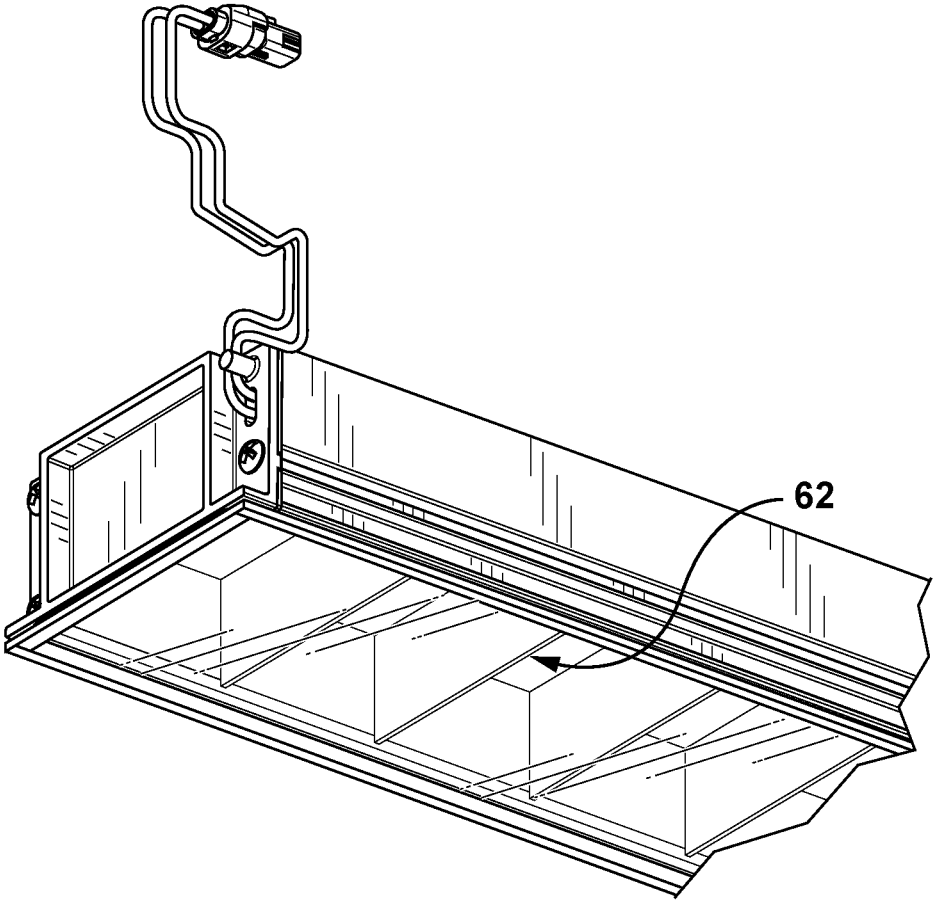
FIG. 11 is a sectional and fragmentary perspective view of a lower LED cartridge of the device of FIG. 1.
Figure 12:
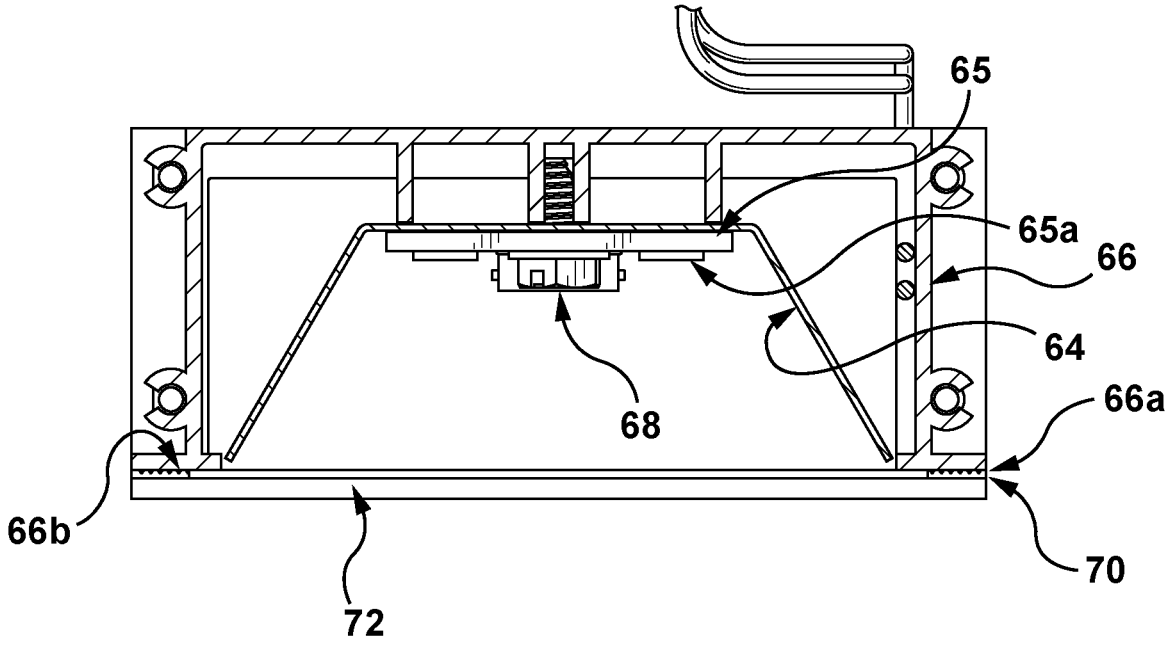
FIGS. 12 and 13 are sectional and fragmentary perspective views of another LED cartridge.
Figure 14:
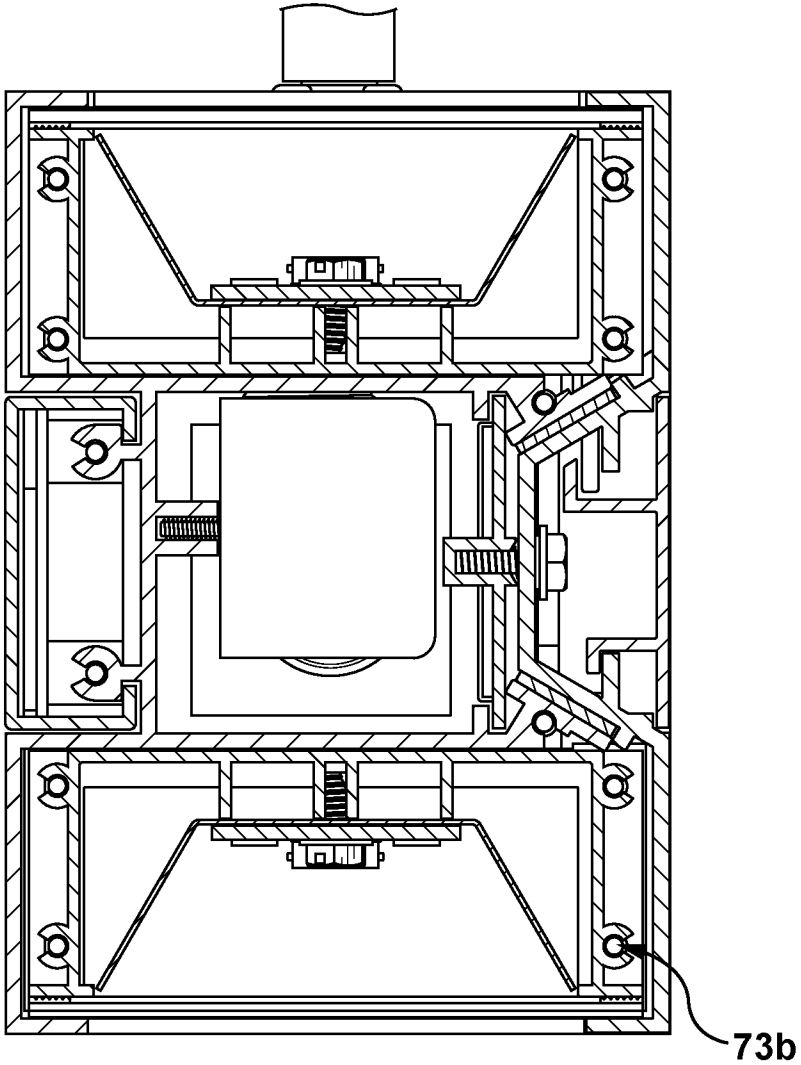
FIG. 14 is a cross sectional view of a light fixture device utilizing two of the cartridges of FIGS. 12 and 13.
Figure 13:
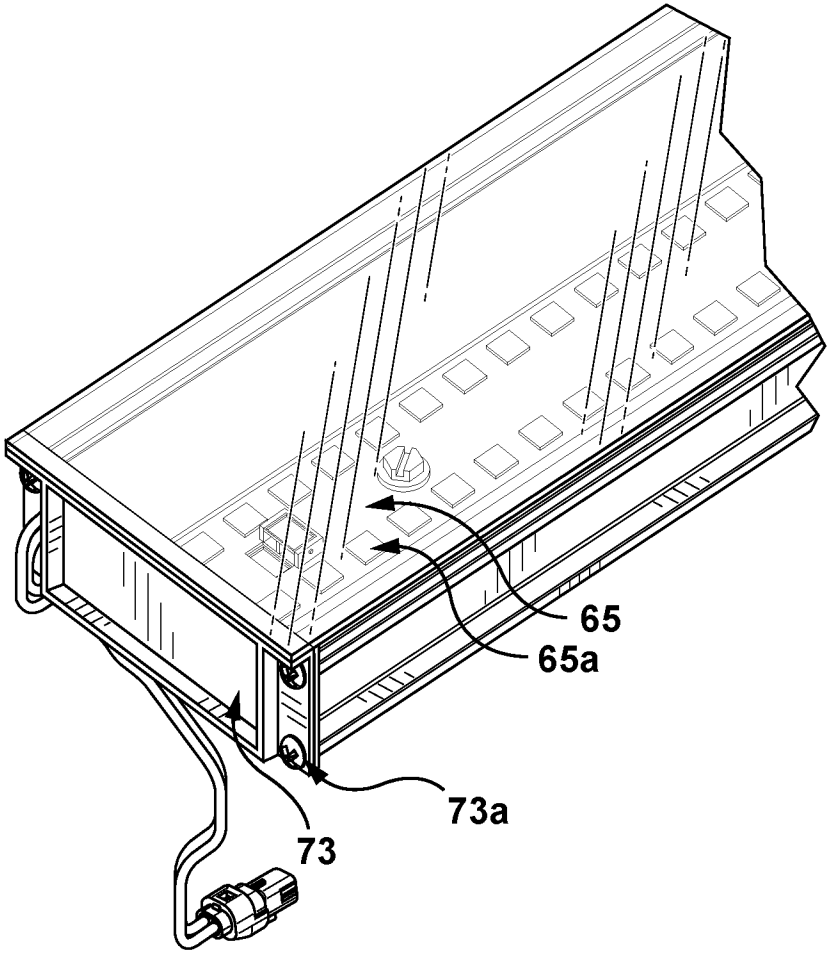
Figure 15:
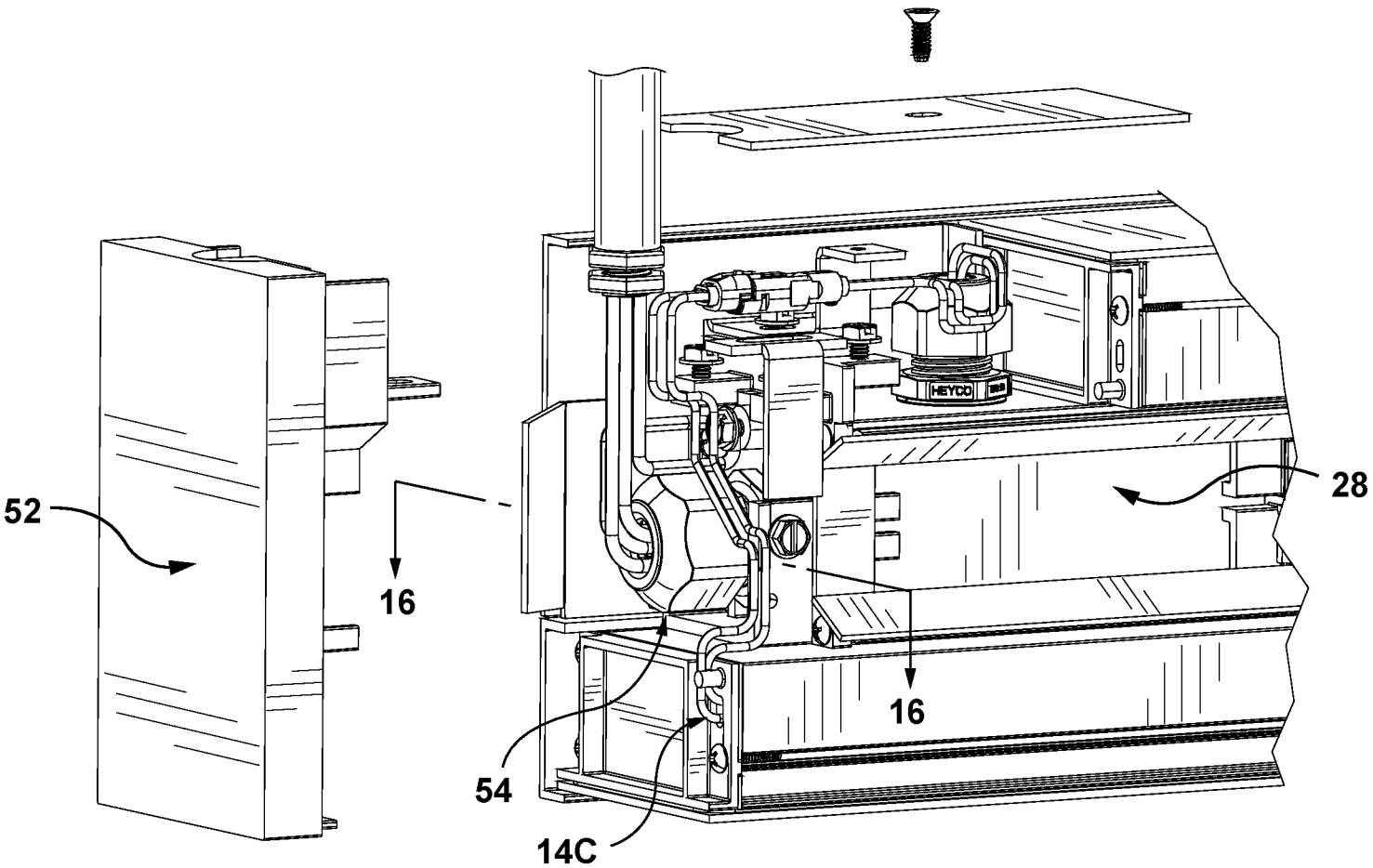
FIG. 15 is a fragmentary exploded perspective view of a portion of the device of FIG. 2.
Figure 16:
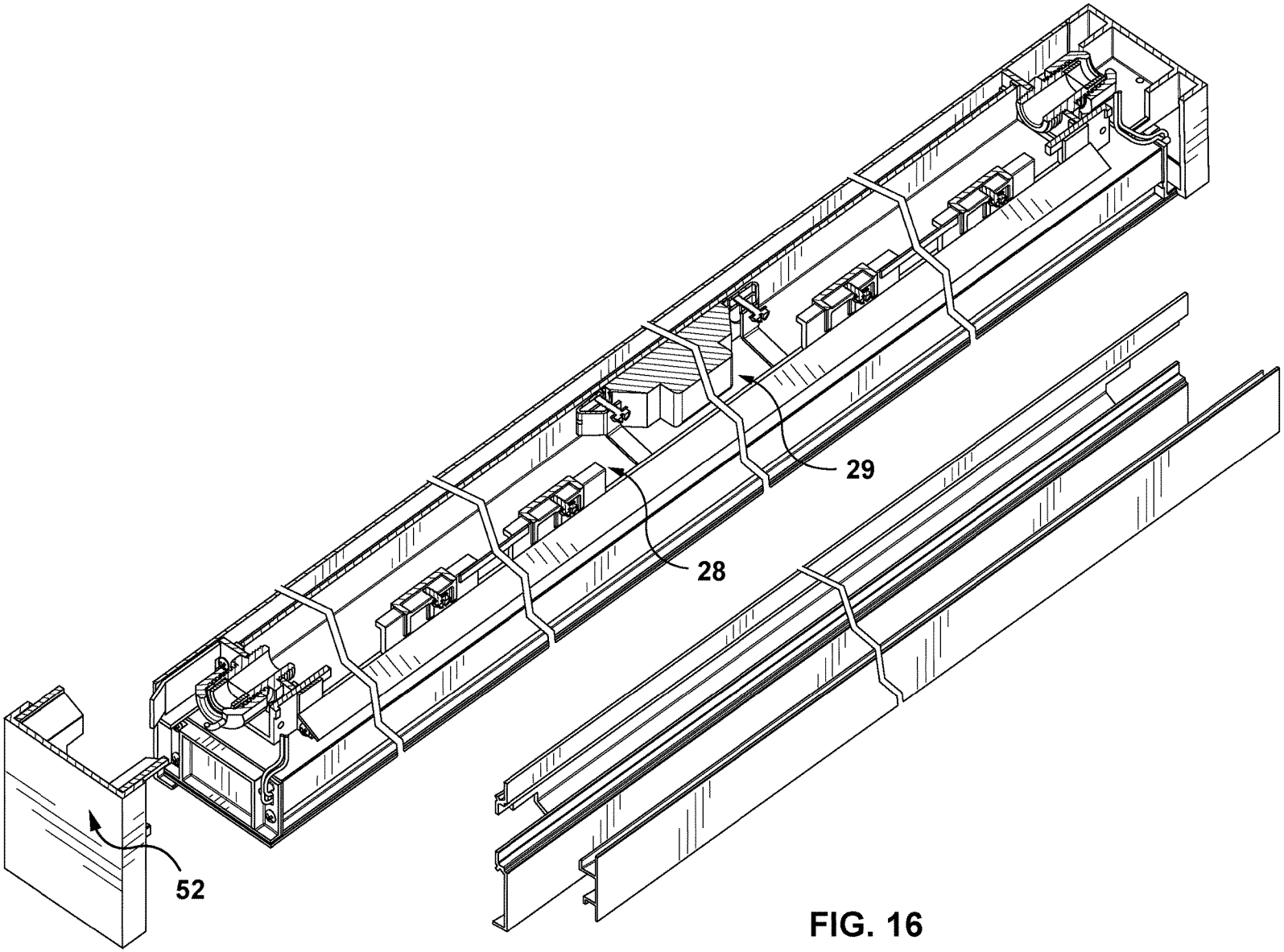
FIG. 16 is a fragmentary exploded sectional perspective view according to FIG. 15 and taken on line 16-16 thereof.

In some example embodiments, different configurations may be employed for the upper and lower cartridges 12 and 14. For instance, as shown in FIG. 4, each cartridge 12, 14 may be provided with an array of LED's mounted on a board. Referring to FIG. 11, the cartridges may include louvers 62 or other optical elements. Referring to FIG. 12, the cartridges may be provided with concave reflectors 64. In this case, reflector 64 and a board 65 with an array of LEDs 65*a*, may be held in an extruded housing 66 with a fastener 68. The housing 66 may be provided with an opening defined by outer surfaces 66*a*, 66*b* which may be surface treated to receive an adhesive layer 70 and the lens 72 or other cover plate, and along with an end cap provided at 73 in FIGS. 13, 14, fastened in place by fasteners 73*a* in corresponding passages 73*b*.

In some example embodiments, as shown in FIG. 4, the cartridge 12 may include a light guide 12*d*, 14*d*, and at least one LED array 12*e*, 14*e*, mounted on a corresponding at least one board 12*f*, 14*f*. The at least one LED array 12*e*, 14*e* is aligned with a first edge region 12*g*, 14*g*, of the light guide 12*d*, 14*d*, with at least one reflector 12*h*, 14*h* positioned adjacent the light guide 12*d*, 14*d*. The at least one reflector 12*h*, 14*h* may include a first segment 12*i*, 14*i* extending, least in part, between the first edge region 12*g*, 14*g* and a second edge region 12*j*, 14*j*, and a second segment 12*k*, 14*k*, extending, at least in part, along the second edge region 12*j*, 14*j*. Thus, one or more configurations such as, but not limited to the example embodiments as represented in FIG. 4, may provide symmetrical light distribution with a single LED array in an edge-lit configuration, which may be applied to other light fixture configurations.

Referring to FIG. 8 in addition to the gasket elements 48*a* and 48*b*, forming sealing interfaces 50*a*, and 50*b* and central gasket 56*a*, other gaskets may be provided elsewhere between the various joints as needed. The interfaces 50*a*, 50*b* may be configured, in some example embodiments, with the respective surfaces 32*a*, 32*b* and 46*a*, 46*b* oriented at an angle θ (as shown in FIG. 4, for example of approximately 30 to approximately 50 degrees relative to the axis of travel of the fastener 58), may provide amplified mechanical advantage to increase the pressure exerted on the gasket elements 48*a*, 48*b* to ensure sealing thereof. Example embodiments may provide ingress protection ratings of IP65 or IP66 (according to the IP Code, International Protection Marking, IEC standard 60529, and en.wikipedia.org/wiki/IP_Code. In some embodiments, the sealing configuration for one or more of the cartridges may enable them to achieve an ingress protection rating of IP66. Further, in some exemplary embodiments, the device may configured to be used in indoor installations with or without the need for sealing either the cartridge receiving region or the cartridges themselves, to the same degree that may be required in outdoor applications.

Referring to FIGS. 6 and 8, in some example embodiments, the opposed linear cartridge-receiving zones 24, 26 may be configured to share one or more common mounting interfaces with the upper and lower cartridges 12, 14, in part provided by inner surfaces on each of the end regions 34*a*, 34*b*, 38*a*, 38*b* on the first and second linear housing structures 22 and 30 and the opposing inner surfaces on the support walls 22*a*, 22*b*, facing the upper and lower cartridge-receiving zones 24, 26. This configuration thus enables surfaces 12*e*, 12*f*, 14*e*, 14*f* (as shown in FIG. 4) on the upper and lower cartridges 12, 14 to form mounting (in this case sliding) interfaces (shown in FIGS. 8) 74*a*, 74*b* and 74*c* for the upper cartridge-receiving zone 24, and at 76*a*, 76*b* and 76*c* for the lower cartridge-receiving zone 26 and configured for engagement and disengagement along a lateral travel path 78 (FIG. 4), thus enabling assembly and servicing through an access opening formed by the separation of the second linear housing structure 30. With common mounting interfaces between both the cartridge-receiving zones and the cartridges to be received therein, either cartridge may be located in either cartridge-receiving zone. Further, the cartridges themselves may be provided in a kit of cartridges which may include both light-emitting cartridges as shown, or non-light emitting cartridges which may provide other illuminating or non-illuminating functions. As illustrative examples, light-emitting cartridges providing a soft/diffuse light output may be may be interposed between other light-emitting cartridges which provide focused/directional light emission, or combinations thereof with other non-light-emitting cartridges which provide baffling panels and the like, such as those employing features or characteristics as disclosed in any of the applications incorporated by reference and listed in paragraph [0002] above.

While the illustrated example embodiment of FIGS. 4, 6 and 8 provide sliding interfaces 74*a* to 74*c* and 76*a* to 76*c*, other non-sliding mounting interface configurations may be deployed which enable assembly and disassembly of the one or more cartridges from their respective cartridge-receiving zones through the access provided by the removal of the second linear housing structure 30, or part thereof, to provide access to the corresponding cartridge receiving zones 24, 26. Further, in some example embodiments, access to such cartridge-receiving or other zones for assembly/disassembly may be achieved by removing a portion of the second linear housing structure 30, to expose one such cartridge-receiving zone while leaving the other cartridge receiving zone covered or otherwise inaccessible for removal of the corresponding cartridge.

The light fixture may be assembled and/or installed as follows. First, a designated light fixture location may be prepared by providing at least one first housing structure defining at least two opposed cartridge-receiving zones, each with a corresponding light output region extending along opposite boundaries, each cartridge-receiving zone open to a lateral boundary between the light output regions and configured to receive an instance of at least one sealed LED lighting cartridge; and at least one second housing structure to sealingly engage the at least one first housing structure at the lateral boundary.

Next, at least one first housing structure may be installed at a light fixture location to present at least one of the cartridge-receiving zone, and in the case of the light fixture 10 (and with reference to FIGS. 4 and 8), the upper and lower cartridge receiving zones 24 and 26. A plurality of cartridges may also be provided, including at least one instance of the LED lighting cartridge along with other cartridges which may include another of the same LED lighting cartridge or a different LED lighting cartridge, or a different type of cartridge such as those mentioned elsewhere herein. In the example embodiment of FIGS. 4 and 8, the two common LED lighting cartridges 12 and 14 may thus be provided and which are then installing in the presented corresponding cartridge-receiving zones 24 and 26. Next, the at least one second housing structure (which in the example of light fixture 10 is the second linear housing structure 30) is installed to sealingly close the cartridge-receiving zones 24 26 with the LED lighting cartridges 12 and 14 therein.

Another exemplary embodiment is shown in FIGS. 19 to 22, in which a light fixture system comprises at least two opposed housing structures 82, 84 configured to mutually engage to form a light fixture housing 86 with a pair of opposed boundaries 88, 90. The one or more of the housing structures are further configured to define a lower cartridge-receiving zone 92 adjacent the light fixture boundary 90. The cartridge-receiving zone 92 is configured to receive an instance of at least one sealed cartridge 94. At least one of the housing structures or a portion thereof is also removable to expose an upper cavity and/or the cartridge receiving zone 94 from a side region of the light fixture housing 86, and in the case of zone 92, to enable the cartridge 94 to be installed or removed therefrom when the light fixture housing is in position at a light fixture location. The boundary 88 is provided in this example as a panel 89 which may be mounted to a ceiling structure or the lie by way of fasteners or the like (not shown).

In some example embodiments, the light fixture housing 86 may be provided on its own, while other exemplary embodiments may further comprise at least one instance of the cartridge 94. The at least one instance of the cartridge 94 may include a plurality of cartridges including at least one LED lighting cartridge.

In some example embodiments, a first of the housing structures 82 may include inner structure 95*a*, 95*b* to form at least one inner mounting interface with a corresponding cartridge in a corresponding cartridge-receiving zone, as can be seen as sliding interface 96*a*. In this case, the first housing structure 82 and/or the second housing structure 84 may include outer structure to form at least one outer mounting interface with a corresponding cartridge in a corresponding cartridge-receiving zone, as can be seen as sliding interfaces 96*b*, 96*c*. Each mounting interface 96*a*, 96*b* and 96*c* may include at least a pair of complementary surfaces respectively on the inner or outer structure and the corresponding cartridge.

Figure 20:
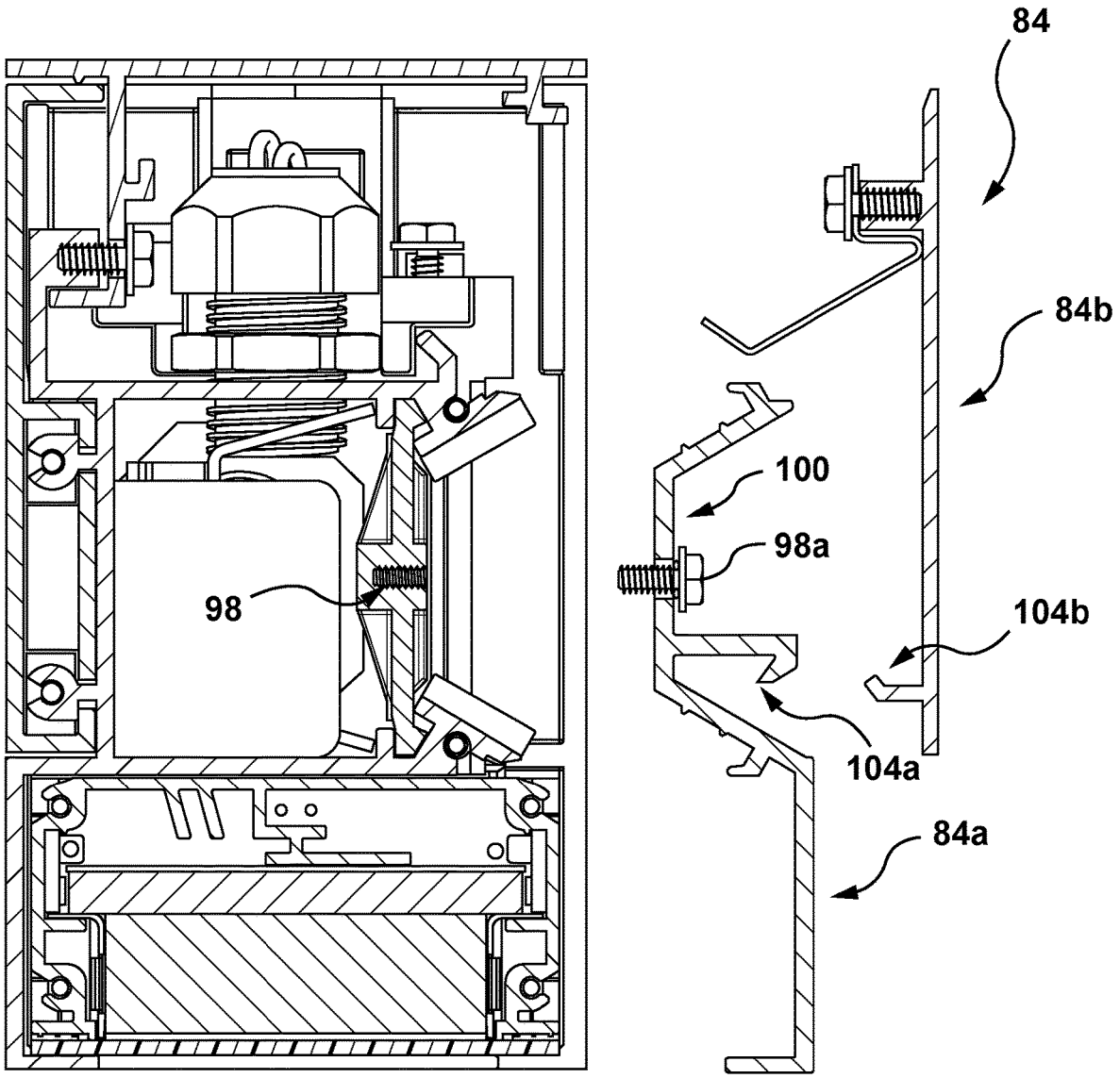
FIGS. 20 to 22 are sequential assembly sectional views of the device of FIG. 19.
Figure 21:
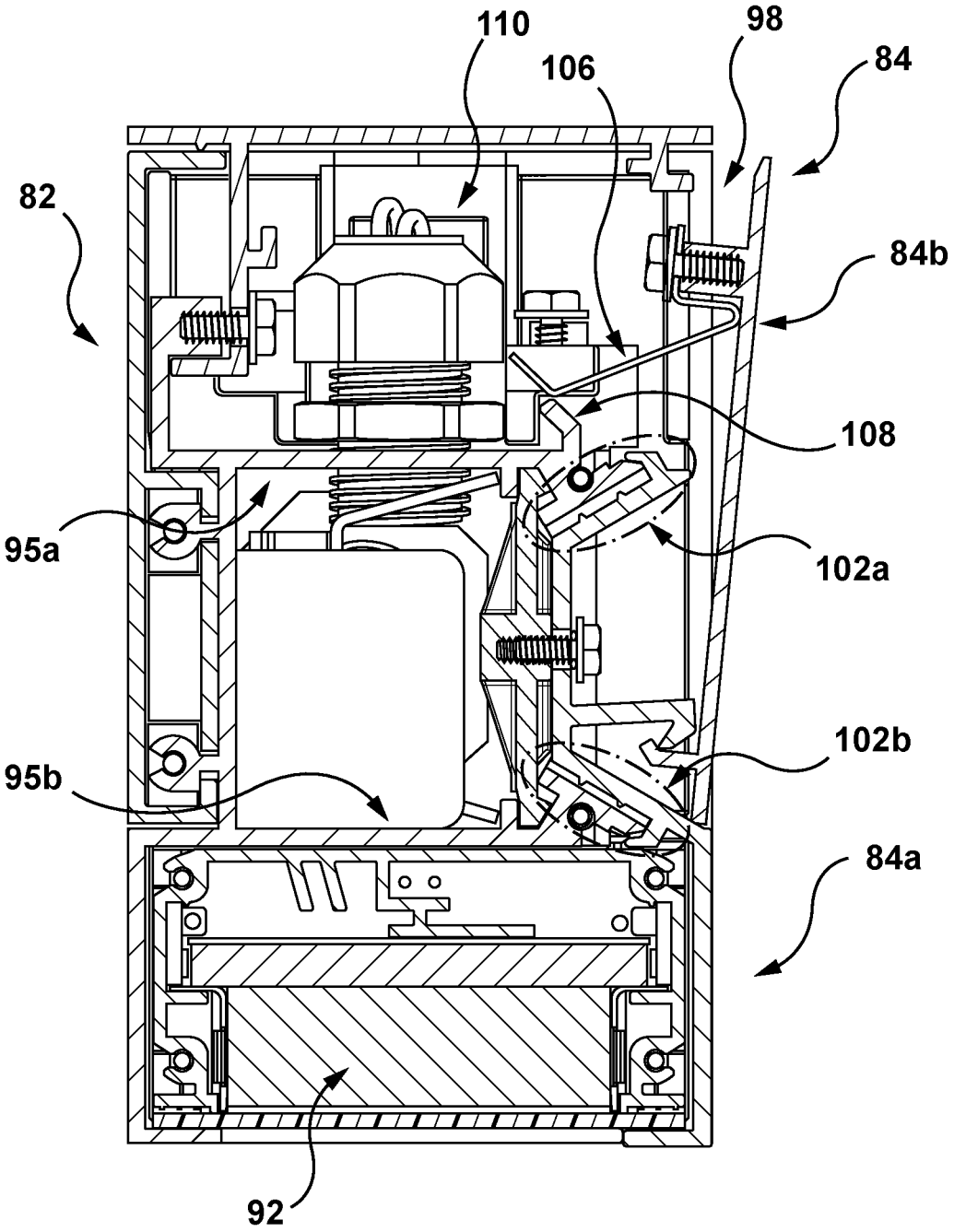
Figure 22:
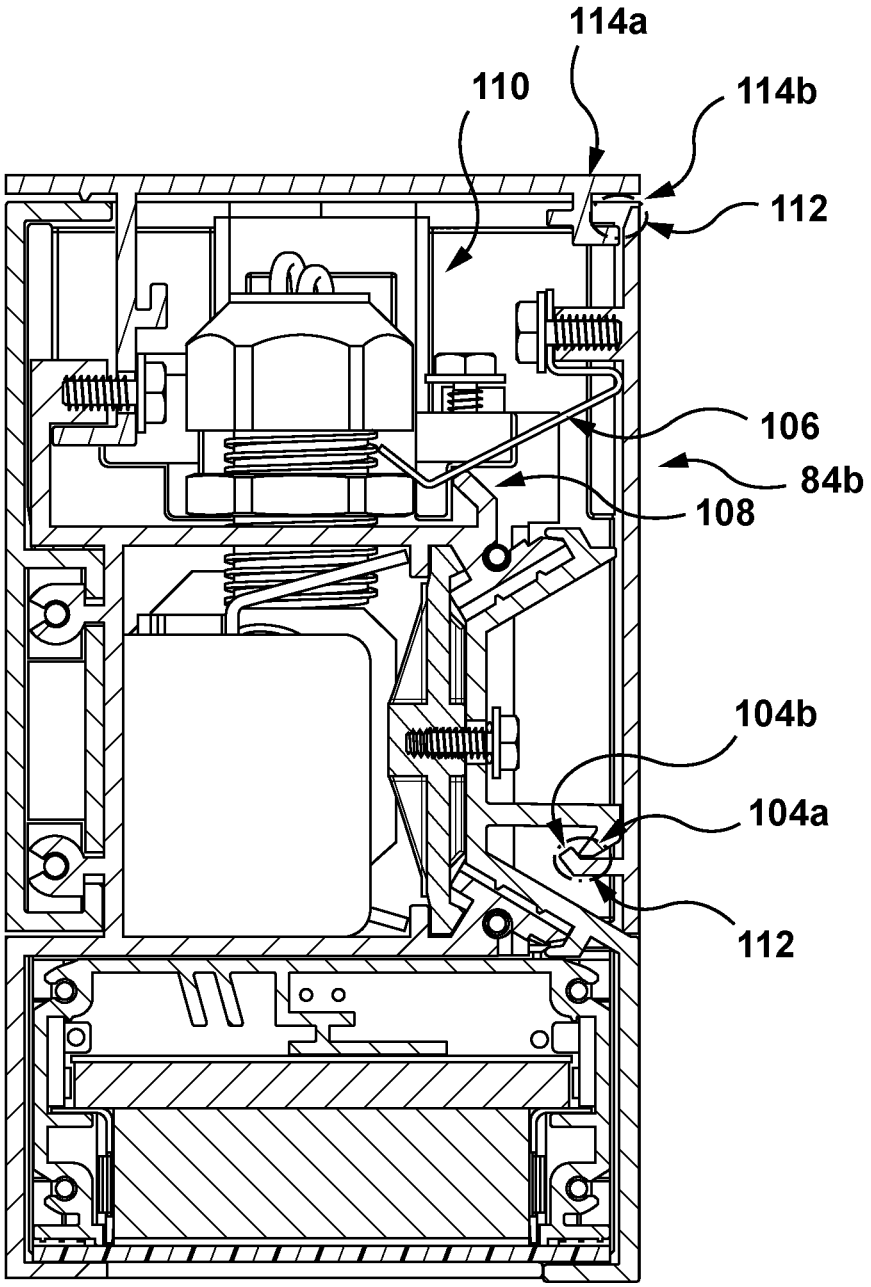

In some example embodiments (as shown at FIGS. 20, 21), the second housing structure 84 may include a lower housing portion 84*a* which is removably secured to anchor structure 98 by way of fastener 98*a* extending through a passage in offset central portion 100. The latter is provided with sealing interfaces 102*a*, 102*b* to seal the cartridge receiving zone 92, defined by the first housing structure 82, and the lower housing portion 84*a*. Cooperating tabs 104*a*, 104*b* on the lower and upper housing portions 84*a*, 84*b* may be configured to serve as a lower pivot coupling for the upper housing portion 84*b* to rotate from an open position as shown in FIG. 21 to a closed position in FIG. 22, in which a clip 106 on the upper housing portion 84*b* engages a corresponding locating flange 108 to hold the upper housing portion 84*b* in a releasably closed position to close the adjacent inner cavity 110. If desired, a sealant, such as a gasket or a layer of silicone shown at 112, may be provided at designated locations such as along the upper housing at the lower tabs 104*a*, 104*b*, and/or along other edges and regions such as adjacent upper boundary regions at 114*a*, 114*b*, Thus, the upper housing portion 84*b* in this instance serves to conceal the fastener and to close the inner cavity 110, and is releasable from the first housing structure to form a side opening to access inner cavity 110 which, in this case, can be seen not to be configured to receive the cartridge 94.

While the present disclosure describes various exemplary embodiments, the disclosure is not so limited. To the contrary, the disclosure is intended to cover various modifications and equivalent arrangements, as will be readily appreciated by the person of ordinary skill in the art.

The invention claimed is:

1. A linear light fixture device comprising at least one sealed linear LED lighting cartridge having a sealed casing with a linear lens region along one boundary thereof, and at least one power supply element extending or accessible from the casing connectible with a power source, and a linear housing having at least one first linear housing structure defining at least two opposed linear cartridge-receiving zones, each with a corresponding light output region, at least one linear cartridge-receiving zone configured to receive an instance of the at least one sealed linear LED lighting cartridge with the linear lens region alignable with the corresponding light output region;

a central interior cavity to accommodate the power supply elements and between, at least in part, the linear cartridge-receiving zones;

at least one second linear housing structure to sealingly engage the at least one first linear housing structure;

the at least one first linear housing structure defining a pair of opposed first linear sealing surface regions with each first linear sealing surface region adjacent a corresponding linear cartridge-receiving zone;

each first linear sealing surface region is located between a corresponding linear cartridge-receiving zone and the central interior cavity;

the at least one first linear housing structure including a first housing panel bordering a first linear boundary of each of the linear cartridge-receiving zones, the at least one second linear housing structure comprises a second housing panel which borders a second linear boundary of each of the linear cartridge-receiving zones;

the first housing panel includes a first central portion bordering the central interior cavity, and presenting the first linear sealing surface regions; and wherein the second housing panel includes a second central portion with opposed second linear sealing surface regions to sealingly engage the respective first linear sealing surface regions.

2. The device as defined in claim 1, further comprising at least a pair of gasket elements to be located in respective sealing interfaces between each first linear sealing surface region and a corresponding second linear sealing surface region.

3. The device as defined in claim 2, wherein the first linear housing structure includes at least one end cap segment to sealingly engage with the first and second housing panels.

4. The device as defined in claim 3, wherein the central interior cavity includes a cavity adjacent the end cap segment to form a passage for the one or more power supply elements extending from one end of the at least one linear LED lighting cartridge and the central interior cavity.

5. The device as defined in claim 1, further comprising an anchor structure adjacent the central interior cavity to be alignable with the second central portion for anchoring the second central portion thereto.

6. The device as defined in claim 5, wherein the second central portion and the anchor structure include aligned passages to receive at least one anchoring fastener therebetween.

7. The device as defined in claim 6, further comprising at least cover portion to conceal and/or cover the first housing panel or the second housing panel, at least in part.

* * * * *